US011059688B2

(12) United States Patent
Takahashi et al.

(10) Patent No.: US 11,059,688 B2
(45) Date of Patent: Jul. 13, 2021

(54) PRINTER

(71) Applicants: CITIZEN WATCH CO., LTD., Tokyo (JP); CITIZEN SYSTEMS JAPAN CO., LTD., Tokyo (JP)

(72) Inventors: Akira Takahashi, Iida (JP); Naohisa Sawai, Kodaira (JP)

(73) Assignees: CITIZEN WATCH CO., LTD, Tokyo (JP); CITIZEN SYSTEMS JAPAN CO., LTD., Tokyo (JP)

( * ) Notice: Subject to any disclaimer, the term of this patent is extended or adjusted under 35 U.S.C. 154(b) by 0 days.

(21) Appl. No.: 16/815,340

(22) Filed: Mar. 11, 2020

(65) Prior Publication Data

US 2020/0290836 A1 Sep. 17, 2020

(30) Foreign Application Priority Data

Mar. 14, 2019 (JP) ..... JP2019-047309
Sep. 6, 2019 (JP) ..... JP2019-162628

(51) Int. Cl.
*B65H 23/34* (2006.01)
*B65H 29/60* (2006.01)
(Continued)

(52) U.S. Cl.
CPC ..... *B65H 23/34* (2013.01); *B41J 11/0005* (2013.01); *B41J 11/70* (2013.01);
(Continued)

(58) Field of Classification Search
CPC .... B65H 23/24; B65H 23/044; B65H 23/048; B65H 23/06; B65H 23/063; B65H 23/066; B65H 23/08; B65H 23/085; B65H 23/10; B65H 23/105; B65H 23/14; B65H 23/16; B65H 29/60; B65H 35/0073; B65H 23/26; B65H 2301/5151; B65H 2301/41346; B65H 2801/12; B65H 2402/632;
(Continued)

(56) References Cited

U.S. PATENT DOCUMENTS 5,566,906 A 10/1996 Kamada et al.
6,921,222 B2 * 7/2005 Ng ..... B65H 23/1888 400/613
(Continued)

FOREIGN PATENT DOCUMENTS

JP 61-124463 6/1986
JP 6-98078 4/1994
(Continued)

*Primary Examiner* — Jeremy R Severson
(74) *Attorney, Agent, or Firm* — Wenderoth, Lind & Ponack, L.L.P.

(57) ABSTRACT

A printer includes a first route to which a sheet from a roll paper is to be fed, a drive roller arranged on the first route and capable of sending the sheet, an image forming part (thermal printer head), a second route branched from the first route, a route changer for switching a route of the sheet, a curl corrector provided on the second route, and a cutter (cutting unit) provided on the first route. The curl corrector is configured to form the route with a curl correction roller and a guide member, and an advancing direction of the route is changeable 100 degrees or more when the sheet passes through the curl corrector.

7 Claims, 15 Drawing Sheets

(51) Int. Cl.

| | |
|---|---|
| ***B65H 35/00*** | (2006.01) |
| ***B65H 23/26*** | (2006.01) |
| ***B41J 11/00*** | (2006.01) |
| ***B41J 11/70*** | (2006.01) |
| *B41J 15/04* | (2006.01) |

(52) U.S. Cl.
CPC ..... *B65H 23/26* (2013.01); *B65H 29/60* (2013.01); *B65H 35/0073* (2013.01); *B41J 15/042* (2013.01); *B65H 2301/41346* (2013.01); *B65H 2301/5151* (2013.01); *B65H 2301/51256* (2013.01); *B65H 2404/632* (2013.01); *B65H 2801/12* (2013.01)

(58) Field of Classification Search
CPC ..... B65H 2301/51256; B41J 11/0005; B41J 11/70; B41J 15/042
See application file for complete search history.

(56) References Cited

U.S. PATENT DOCUMENTS

| | | | | |
|---|---|---|---|---|
| 7,618,204 | B2 * | 11/2009 | Blanchard, Jr. ..... | B41J 3/4075 400/618 |
| 10,850,541 | B2 * | 12/2020 | Takahashi ..... | B41J 29/38 |
| 2009/0232574 | A1 | 9/2009 | Takahashi et al. | |
| 2018/0244485 | A1 * | 8/2018 | Takahashi ..... | B65H 23/16 |

FOREIGN PATENT DOCUMENTS

| | | |
|---|---|---|
| JP | 9-327952 | 12/1997 |
| JP | 2016-28972 | 3/2016 |

* cited by examiner

PRINTER

CROSS-REFERENCE TO RELATED APPLICATION

The present application is based on and claims priority benefits of Japanese patent application No. 2019-047309 filed on Mar. 14, 2019, as well as Japanese patent application No. 2019-162628 filed on Sep. 16, 2020, the disclosures of which are hereby incorporated herein by reference in their entireties.

BACKGROUND

This disclosure relates to a printer for feeding a sheet from a roll paper.

A printer comprising a curl correction mechanism for correcting curl in a sheet supplied from a roll paper has been taught by, for example, JP1994-98078A.

JP1994-98078A discloses a mechanism in which a sheet fed by a feeding roller from a roll paper enters a curl correction route and a curl in the sheet is corrected by a decurl roller and a pressing plate.

SUMMARY

When passing a sheet fed by a feeding roller through a decurl roller and a pressing plate, wrinkles and/or folds in the sheet may occur. However, JP1994-98078A is silent about such wrinkles and/or folds in the sheet which may occur between the decurl roller and the pressing plate.

An object of the present disclosure is, therefore, to provide a printer which is capable of improving a curl correction effect for a sheet without damaging the sheet with wrinkles and/or folds.

To achieve the above object, a printer of the present disclosure comprises: a first route to which a sheet from a roll paper is fed, a drive roller that is arranged on the first route and capable of sending the sheet in a feeding direction of the sheet and a pullback direction opposite to the feeding direction, an image forming part that is arranged on the first route and forms an image on the sheet, a second route that is branched from the first route, a route changer that is configured to switch a route of the sheet between the first route and the second route, a curl corrector that is provided on the second route and configured to correct curl in the sheet, a cutter that is provided on the first route and configured to cut the sheet. The curl corrector forms a route with a curl correction roller and a guide member positioned to face the curl correction roller, and an angle of an advancing direction of the sheet is changed by 100 degrees or more when the sheet passes through the curl corrector.

DETAILED DESCRIPTION

Hereinafter, embodiments of a printer of the present disclosure will be described in accordance with the first to fourth embodiments shown in the attached drawings.

With respect to the use of plural and/or singular terms herein, those having skill in the art can translate from the plural to the singular and/or from the singular to the plural as is appropriate to the context and/or application. The various singular/plural permutations may be expressly set forth herein for sake of clarity.

First Embodiment

A printer of the first embodiment is applied to a dye-sublimation thermal transfer printer.

Figure 1:
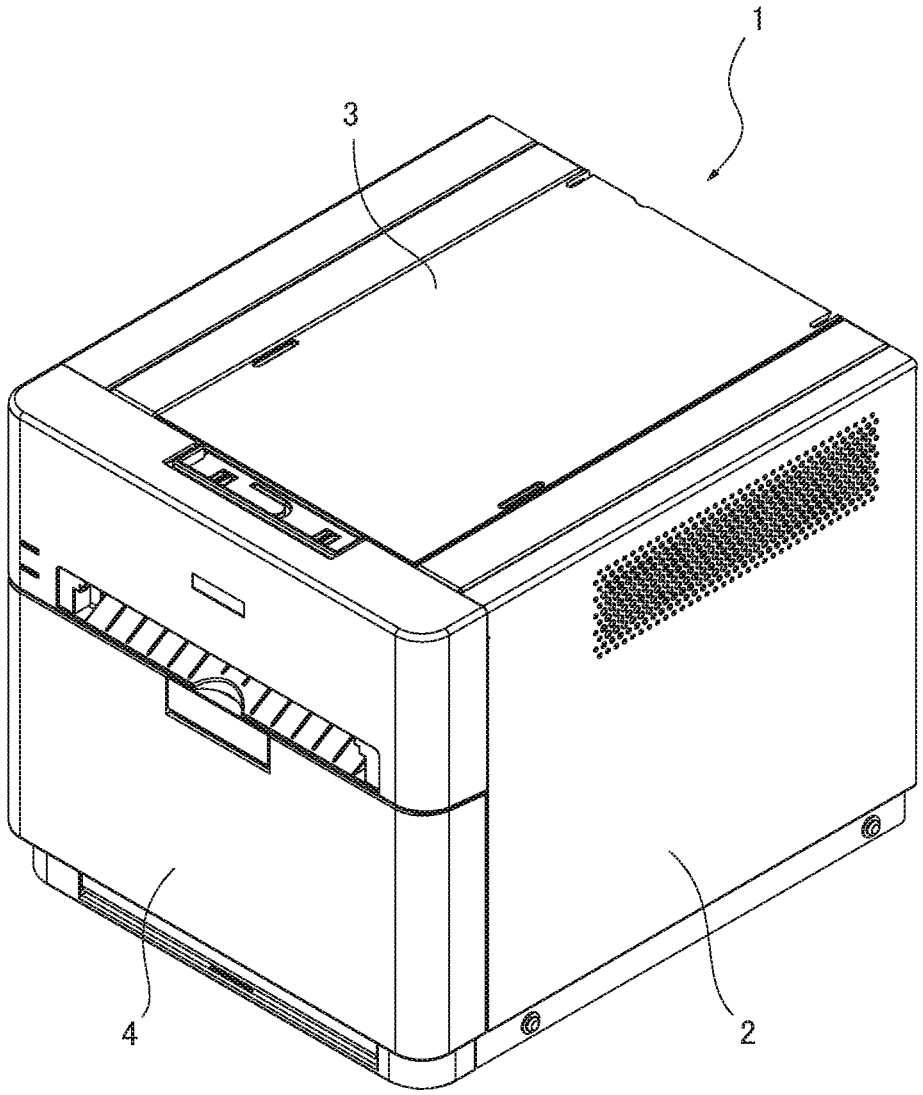
FIG. 1 is a perspective view illustrating a printer of the first embodiment.
Figure 2:
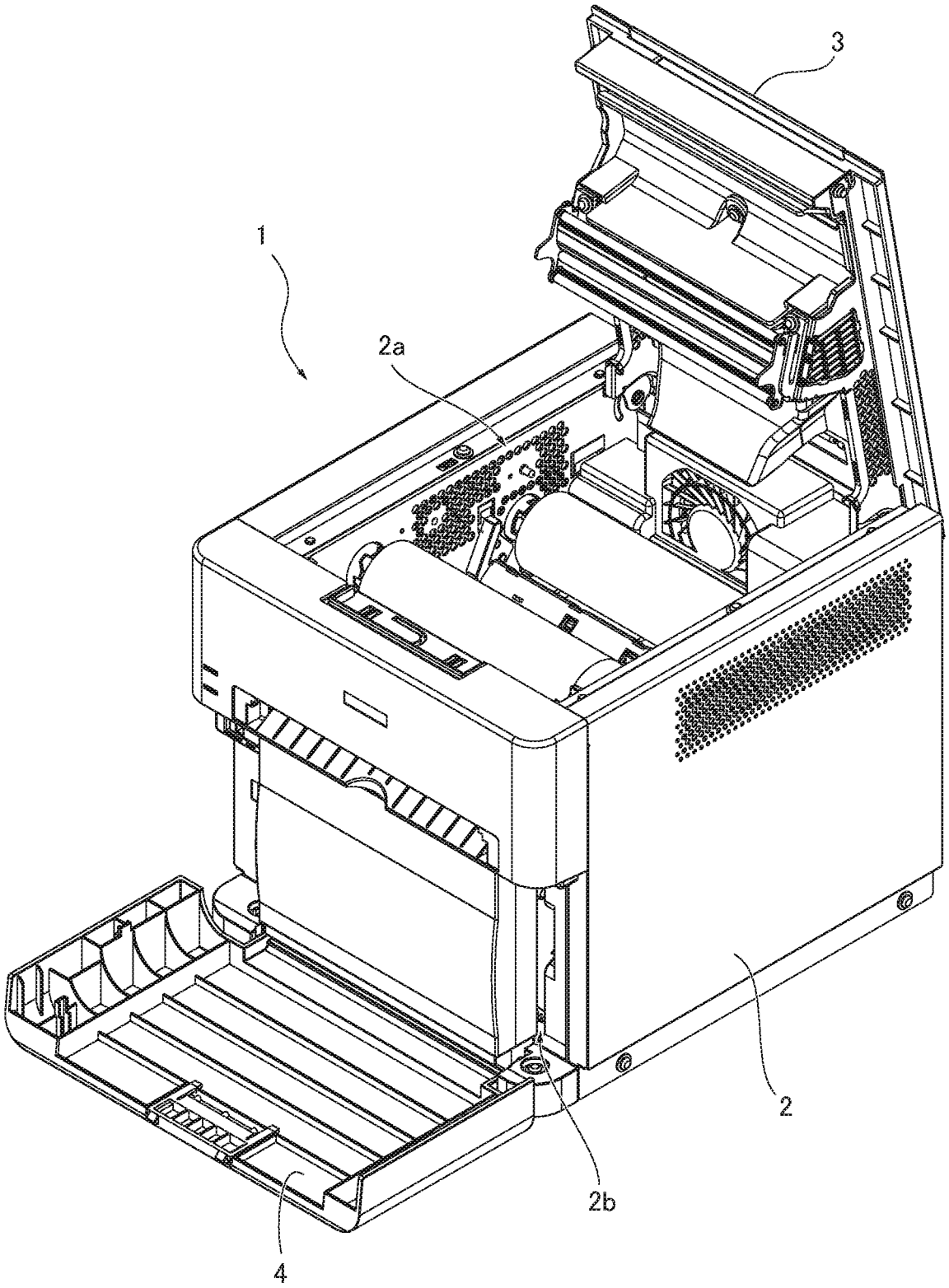
FIG. 2 is a perspective view illustrating the printer of the first embodiment when a cover of the printer is open.
Figure 3:
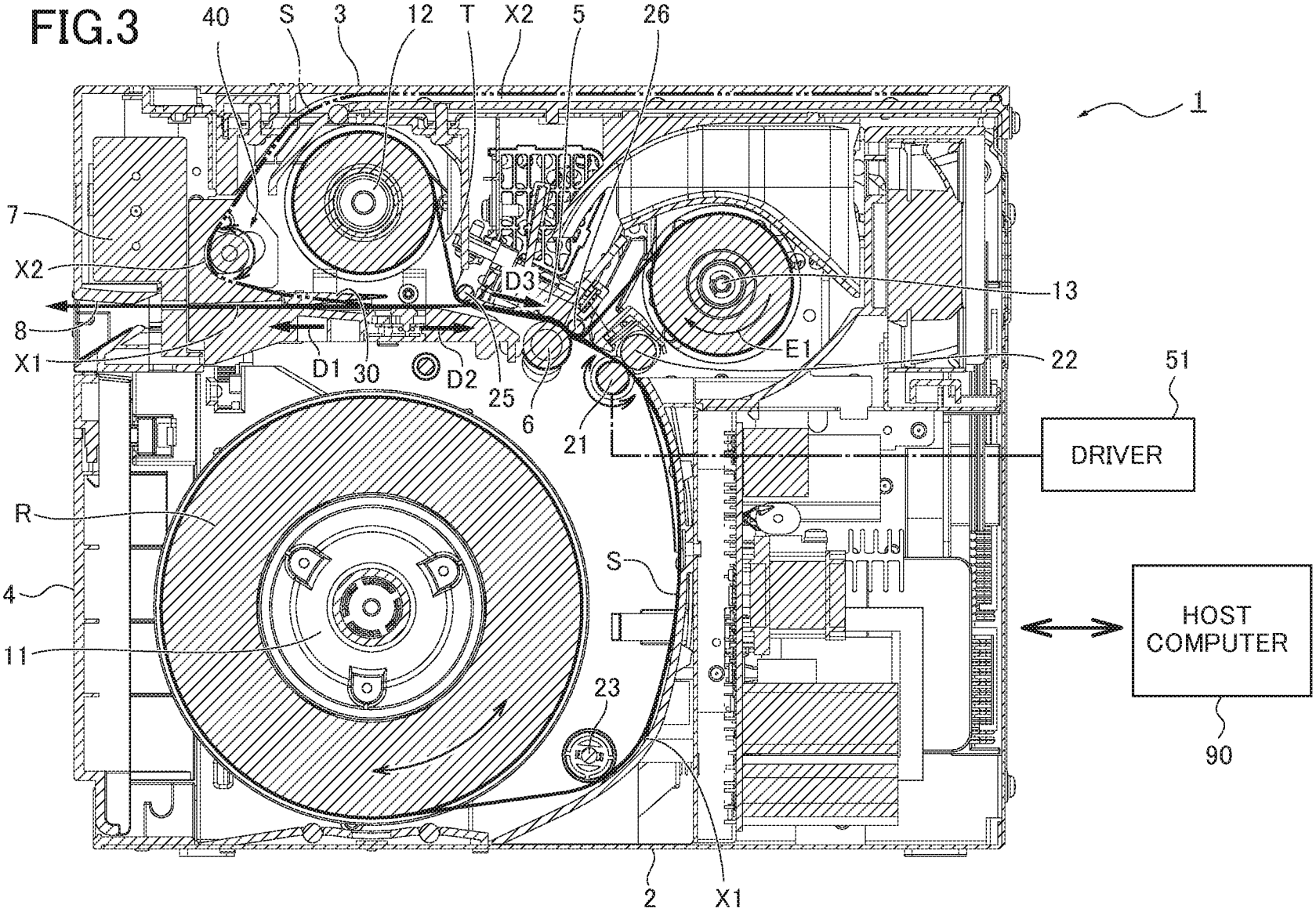
FIG. 3 is a cross-sectional view illustrating the printer of the first embodiment.
Figure 4:
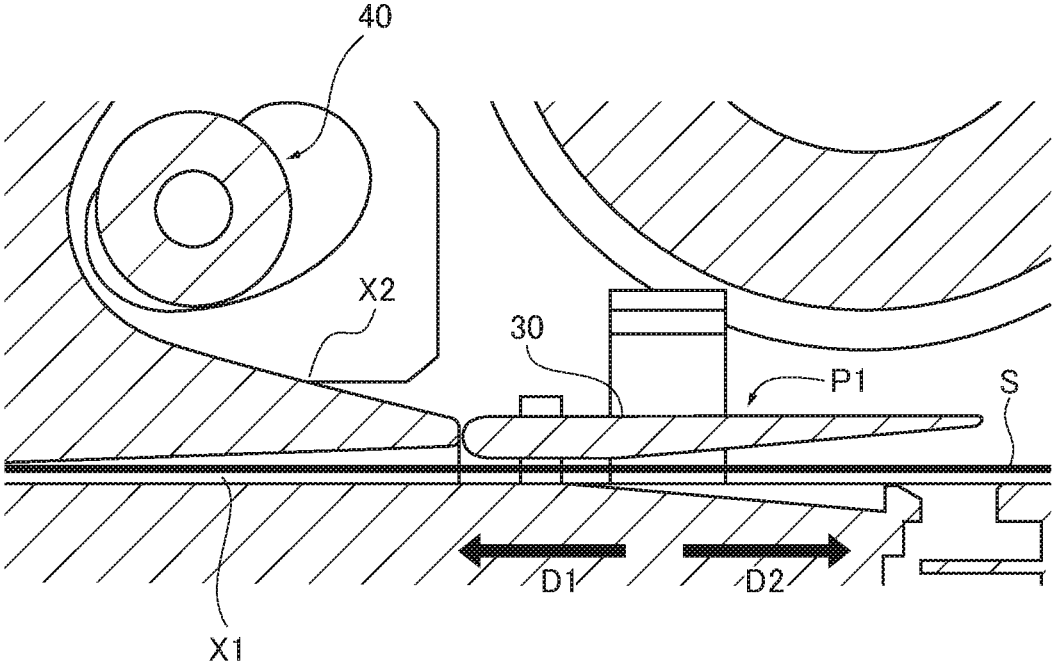
FIG. 4 is a cross-sectional view illustrating a state in which a route changer of the first embodiment is in a first position.
Figure 5:
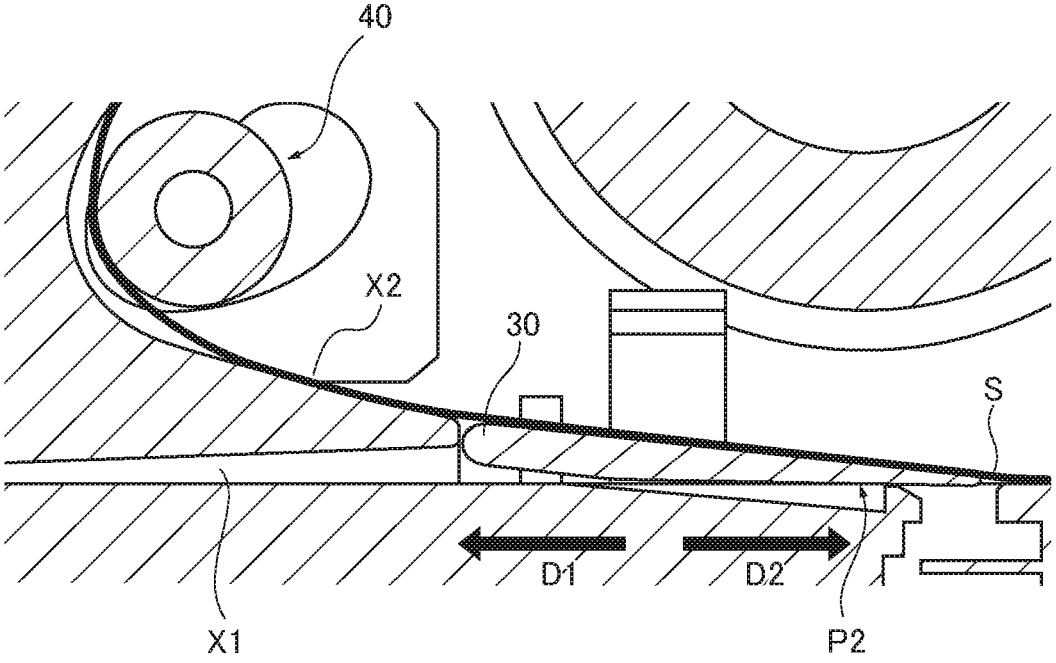
FIG. 5 is a cross-sectional view illustrating a state in which the route changer of the first embodiment is in a second position.

FIG. 1 is a perspective view illustrating a printer of the first embodiment. FIG. 2 is a perspective view illustrating the printer of the first embodiment when a cover of the printer is open. FIG. 3 is a cross-sectional view illustrating the printer of the first embodiment. FIG. 4 is a cross-sectional view illustrating a state in which a route changer of the first embodiment is in a first position. FIG. 5 is a cross-sectional view illustrating a state in which the route changer of the first embodiment is in a second position. The printer of the first embodiment will be described hereinafter with reference to FIGS. 1-5.

As illustrated in FIG. 1 and FIG. 2, the printer 1 includes a box shaped housing 2, a top cover 3 provided at a top opening 2*a* formed on a top surface of the housing 2, and a front cover 4 provided at a front opening 2*b* formed on a front surface of the housing 2.

As illustrated in FIG. 3, the housing 2 contains, inside thereof, a roll paper R which supplies sheets S as recording medium, an inked ribbon T, a thermal printer head 5 as an image forming part, a platen roller 6, a cutting unit 7 as a cutting part, a drive roller 21, a route changer 30 for changing a route for the sheet S, and a curl corrector 40 for correcting a curl in the sheet S.

The sheet S supplied from the roll paper R is fed in a feeding direction D1 along a first route X1 by the drive roller 21 and a driven roller 23, and is ejected from an ejection port 8. When the sheet S is fed to a second route X2 which is branched from the first route X1, the curl in the sheet S is corrected.

The paper for the roll paper R is, for example, a photographic paper thicker than a plain paper. The roll paper R is rotatably supported by a roll holder 11 connected to a motor.

The drive roller 21 is arranged along the first route X1. The drive roller 21 is connected to a driver 51 and is rotatable in a positive direction (i.e., counterclockwise direction) or in a negative direction opposite to the positive direction (i.e., clockwise direction).

A counter roller 22 is arranged along the first route X1 so as to face the drive roller 21. The counter roller 22 is configured to be movable relative to the drive roller 21. When feeding the sheet S, the counter roller 22 abuts the drive roller 21 so as to be rotated by the drive roller 21. By rotating the drive roller 21 in the positive direction, the drive roller 21 and the counter roller 22 feed the sheet S in the feeding direction D1 while sandwiching the sheet S. By rotating the drive roller 21 in the negative direction, the drive roller 21 and the counter roller 22 send or convey the sheet S in the pullback direction D2 while sandwiching the sheet S. The counter roller 22 is separated from the drive roller 21 except when the sheet S is being sent or conveyed.

The thermal printer head 5 is arranged along the first route X1 and is positioned downstream of the drive roller 21 in the feeding direction D1. The platen roller 6 is arranged along the first route X1 and positioned to oppose the thermal printer head 5. The platen roller 6 is configured to be movable with respect to the thermal printer head 5. To print an image, the platen roller 6 moves toward the thermal printer head 5 and is positioned at a pressing position at which the platen roller 6 presses the thermal printer head 5 through the sheet S and the inked ribbon T. The thermal printer head 5 then generates heat while being pressed by the platen roller 6 through the sheet S and the inked ribbon T. As a result, the sublimation dye ink applied on the inked ribbon T is transferred to the sheet S, thereby forming an image on the sheet S. When an image is not printed, the platen roller 6 moves to separate from the thermal printer head 5 and is positioned at a separation position.

The route changer 30 is a plate-shaped member having a tapered tip in cross section. The route changer 30 is positioned downstream of the thermal printer head 5 in the feeding direction D1 of the sheet S. The route changer 30 is positioned at a branch point of the first route X1 and the second route X2. The route changer 30 is configured to move between a first position P1, at which the sheet S is sent to the first route X1 (see FIG. 4), and a second position P2, at which the sheet S is sent to the second route X2 (see FIG. 5). That is to say, by changing an angle of the route changer 30, the route of the sheet S from the thermal printer head 5 is switched between the first route X1 and the second route X2.

As shown in FIG. 3, the cutting unit 7 is arranged along the feeding direction D1 and is positioned downstream of the route changer 30. The cutting unit 7 is configured to cut the sheet S passing through the first route X1.

The inked ribbon T is a belt-shaped sheet in which each of inked regions of yellow Y, magenta M and cyan C, and a region of an overcoat OP are repeatedly arranged along the longitudinal direction (i.e., feeding direction). The inked ribbon T is supported by a ribbon supply reel 12 and a ribbon winding reel 13. The ribbon supply reel 12 supplies or feeds the inked ribbon T, and the ribbon winding reel 13 winds the inked ribbon T.

The ribbon winding reel 13 is connected to a motor and rotates in a rotation direction μl. By rotating the ribbon winding reel 13 in the rotation direction μl, the inked ribbon T is supplied from the ribbon supply reel 12. The inked ribbon T supplied from the ribbon supply reel 12 is sent in a ribbon feeding direction D3 and wound by the ribbon winding reel 13 after passing between the thermal printer head 5 and the platen roller 6 through driven rollers 25, 26.

The printer 1 is connected to a host computer (user terminal) 90 via a local area network (LAN) for sending various commands. The printer 1 executes processes in response to commands from the host computer 90. The host computer 90 records information such as date and time when the roll paper R was replaced and a length of sheets S fed from the roll paper in order to estimate a curl amount of the sheet S.

On the basis of the curl amount of the sheet S estimated by the host computer 90 and/or the color of an image printed on the sheet S, the user is able to select various settings such as a feeding speed of the sheet S, a position of a guide member 42 with respect to a curl correction roller 41, timing and number of curl corrections, and the like.

Figure 6:
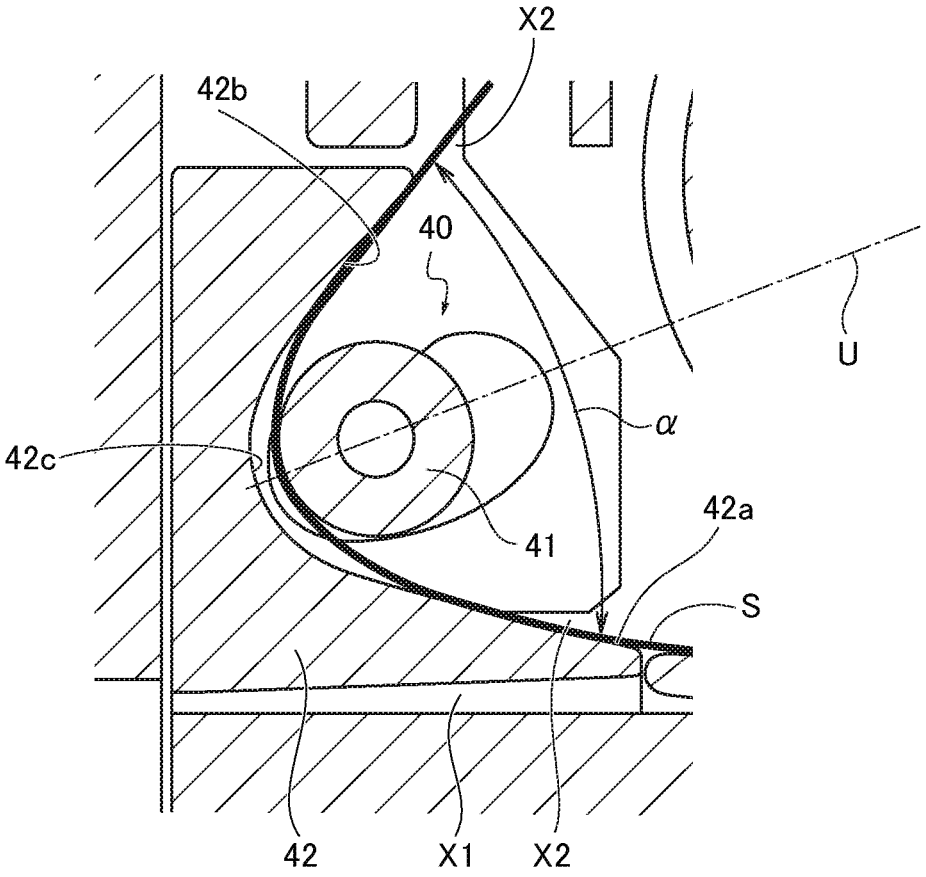
FIG. 6 is a cross-sectional view illustrating a configuration of a curl corrector of the first embodiment.
Figure 7:
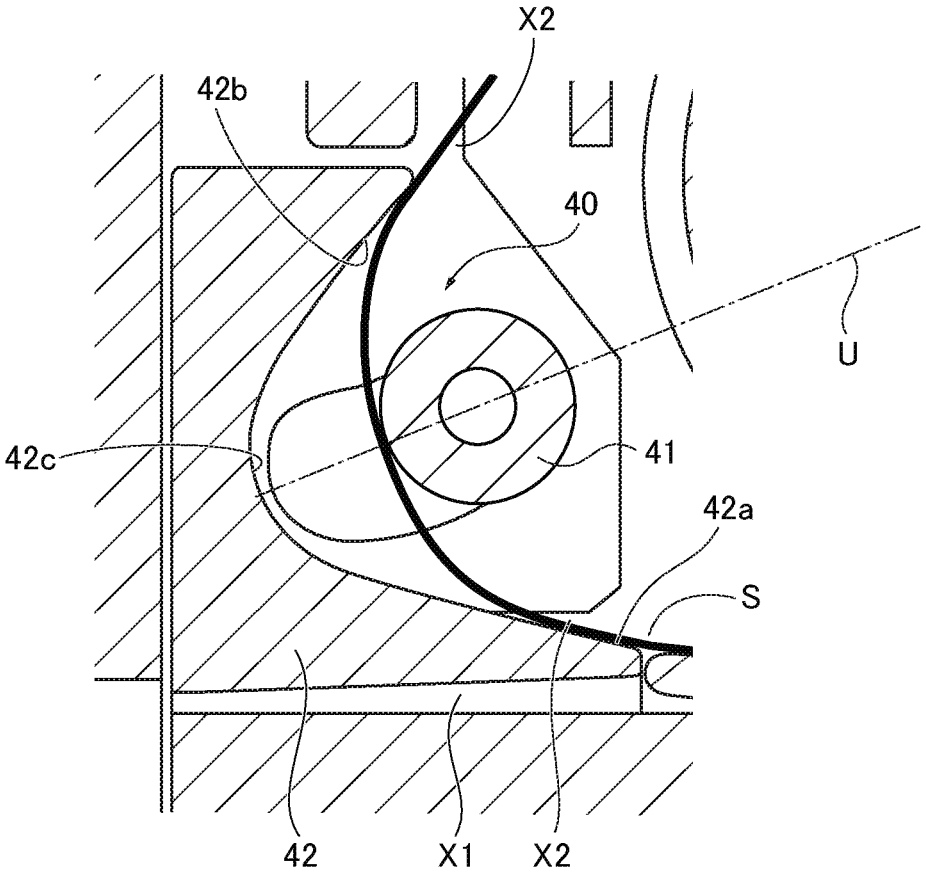
FIG. 7 is a cross-sectional view illustrating the configuration of the curl corrector after a curl correction roller moves.

FIG. 6 is a cross-sectional view illustrating the configuration of the curl corrector 40 of the first embodiment. FIG. 7 is a cross-sectional view illustrating the configuration of the curl corrector 40 after the curl correction roller 41 moves.

As shown in FIG. 6, the curl corrector 40 is arranged along the second route X2. The curl corrector 40 includes the curl correction roller 41 and the guide member 42.

The curl correction roller 41 is arranged along the second route X2 and is positioned on the front side (i.e., on print side) of the sheet S. The curl correction roller 41 is formed in a cylindrical shape having a length equal to or longer than the width of the sheet S.

The guide member 42 is arranged along the second route X2 and is positioned on the back side of the sheet S. The guide member 42 includes a first inclined surface 42*a*, a second inclined surface 42*b*, and a connection curved surface 42*c* that connects the first inclined surface 42*a* and the second inclined surface 42*b*. In the cross-sectional view, the guide member 42 is formed in a symmetrical shape with respect to an axis U, which passes through the center of the curl correction roller 41. The angle α between the first inclined surface 42*a* and the second inclined surface 42*b* is set to 80 degrees.

The connection curved surface 42*c* connects the first inclined surface 42*a* and the second inclined surface 42*b* with a curved surface in the cross-sectional view. The connection curved surface 42*c* is formed to cover a part of the outer peripheral surface of the curl correction roller 41.

The sheet S passes through a gap between the curl correction roller 41 and the guide member 42. The sheet S contacts the first inclined surface 42*a*, the connection curved surface 42*c*, and the second inclined surface 42*b* as passing through the gap, such that the advancing direction of the sheet S is changed by 100 degrees. The route formed of the first inclined surface 42*a*, the connection curved surface 42*c*, and the second inclined surface 42*b* (i.e., route through which the sheet S passes) defines a curl correction route. The curvature radius of the route (i.e., curl correction route) of the sheet S in the curl corrector 40 is set to 12.5 mm.

As shown in FIG. 7, the curl correction roller 41 is configured to be movable in an axial direction of the symmetric axis U. That is, the curl correction roller 41 is movable in the direction of approaching the guide member 42 and in the direction of moving away from the guide member 42.

As shown in FIG. 3, the printer 1 described above rotates the roll holder 11 and rotates the drive roller 21 in the positive direction to feed the sheet S from the roll paper R in the feeding direction D1 through the first route X1. At this state, the route changer 30 is in the first position P1, and the front end of the sheet S is fed to a position beyond the thermal printer head 5. The platen roller 6 is placed at the separate position and remained unmoved. The drive roller 21 then stops its rotation, and the platen roller 6 moves from the separation position to the pressing position.

The drive roller 21 then rotates in the negative direction to send the sheet S in the pullback direction D2. Simultaneously, the ribbon winding reel 13 rotates in the rotation direction μl to feed the inked ribbon T in the ribbon feeding direction D3. At this time, the thermal printer head 5 generates heat while being pressed by the platen roller 6 through the sheet S and the inked ribbon T, and forms an image of yellow Y.

The drive roller 21 then stops its rotation. The platen roller 6 moves from the pressing position to the separation position, and the ribbon winding reel 13 stops its rotation. The drive roller 21 then rotates in the positive direction to feed the sheet S in the feeding direction D1. The front end of the sheet S is fed to the position beyond the thermal printer head 5. The drive roller 21 then stops its rotation, and the platen roller 6 moves from the separation position to the pressing position.

The drive roller 21 then rotates in the negative direction to send the sheet S in the pullback direction D2. Simultaneously, the ribbon winding reel 13 rotates in the rotation direction μl to feed the inked ribbon T in the ribbon feeding direction D3. At this time, the thermal printer head 5 generates heat while being pressed by the platen roller 6 through the sheet S and the inked ribbon T, and forms an image of magenta M.

The drive roller 21 then stops its rotation. The platen roller 6 moves from the pressing position to the separation position, and the ribbon winding reel 13 stops its rotation. The drive roller 21 then rotates in the positive direction to feed the sheet S in the feeding direction D1. The front end of the sheet S is fed to the position beyond the thermal printer head 5. The drive roller 21 then stops its rotation, and the platen roller 6 moves from the separation position to the pressing position.

The drive roller 21 then rotates in the negative direction to send the sheet S in the pullback direction D2. Simultaneously, the ribbon winding reel 13 rotates in the rotation direction μl to feed the inked ribbon T in the ribbon feeding direction D3. At this time, the thermal printer head 5 generates heat while being pressed by the platen roller 6 through the sheet S and the inked ribbon T, and forms an image of cyan C.

The drive roller 21 then stops its rotation. The platen roller 6 moves from the pressing position to the separation position, and the ribbon winding reel 13 stops its rotation. The drive roller 21 then rotates in the positive direction to feed the sheet S in the feeding direction D1. The front end of the sheet S is fed to the position beyond the thermal printer head 5. The drive roller 21 then stops its rotation, and the platen roller 6 moves from the separation position to the pressing position.

The drive roller 21 then rotates in the negative direction to send the sheet S in the pullback direction D2. Simultaneously, the ribbon winding reel 13 rotates in the rotation direction μl to feed the inked ribbon T in the ribbon feeding direction D3. At this time, the thermal printer head 5 generates heat while being pressed by the platen roller 6 through the sheet S and the inked ribbon T, and forms an overcoat OP.

The drive roller 21 then stops its rotation. The platen roller 6 moves from the pressing position to the separation position, and the ribbon winding reel 13 stops its rotation. The route changer 30 moves from the first position P1 to the second position P2. Accordingly, the route of the sheet S is switched from the first route X1 to the second route X2.

The drive roller 21 rotates in the positive direction to feed the sheet S in the feeding direction D1. The sheet S is fed in the second route X2 and passes through the curl corrector 40. The drive roller 21 then changes its rotation direction from the positive direction to the negative direction. The sheets S is thus sent in the pullback direction D2 to pass through the curl corrector 40 again.

The drive roller 21 then stops its rotation. The route changer 30 moves from the second position P2 to the first position P1. Accordingly, the route of the sheet S is switched from the second route X2 to the first route X1. The drive roller 21 then rotates in the positive direction to feed the sheet S in the feeding direction D1. The drive roller then stops its rotation, and the sheet S is cut by the cutting unit 7. The cut sheet S is ejected from the ejection port 8.

It should be noted that the curl correction process may be executed after and/or before the image forming processes (i.e., after yellow image forming process, magenta image forming process, cyan image forming process, and overcoat forming process). Alternatively, the curl correction process may be executed during the image forming processes (e.g., right after cyan image forming process). If a curl amount of the sheet S is relatively small so that the curl correction process is not necessary, the curl correction process may be skipped.

Figure 8:
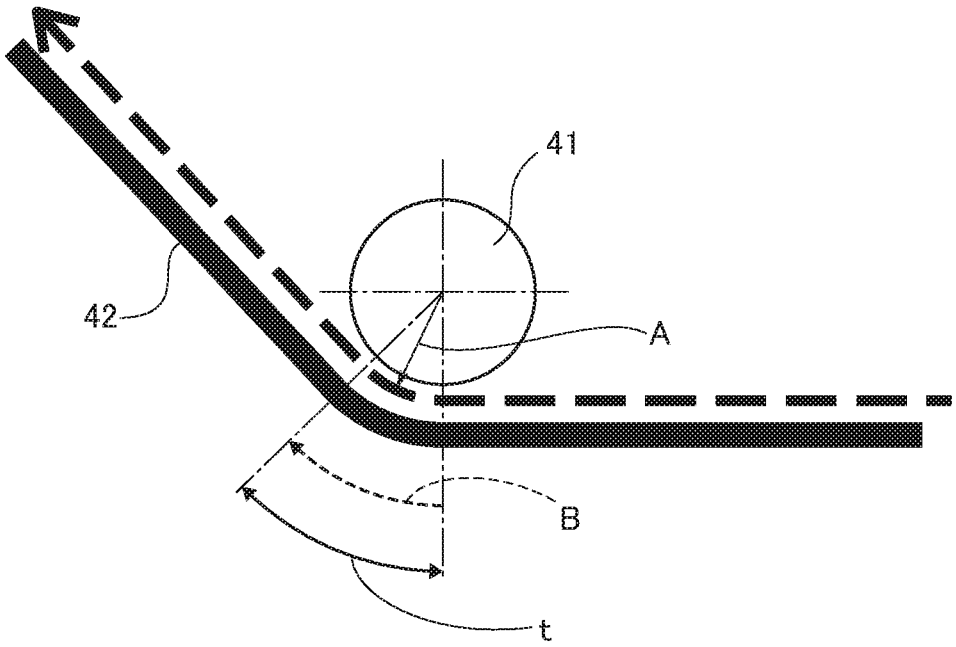
FIG. 8 is an explanatory view for explaining a curl correction effect.

FIG. 8 is an explanatory view for explaining a curl correction effect. The curl correction effect will be described hereinafter with reference to FIG. 8.

As shown in FIG. 8, the curl correction effect is proportional to the product of "the curvature of the route of the sheet S at the curl corrector 40 (decurl curvature) A"×"the changing angle of the advancing direction of the sheet S when the sheet S passes through the curl corrector 40 (decurl angle) B"×"the time for the sheet S to pass through the curl corrector 40 (paper stay time) t".

By adjusting the decurl curvature A, the decurl angle B, and the paper stay time tin accordance with a curl height, it is possible to straighten or flat the sheet S without damaging the sheet with wrinkles and/or folds.

Figure 9:
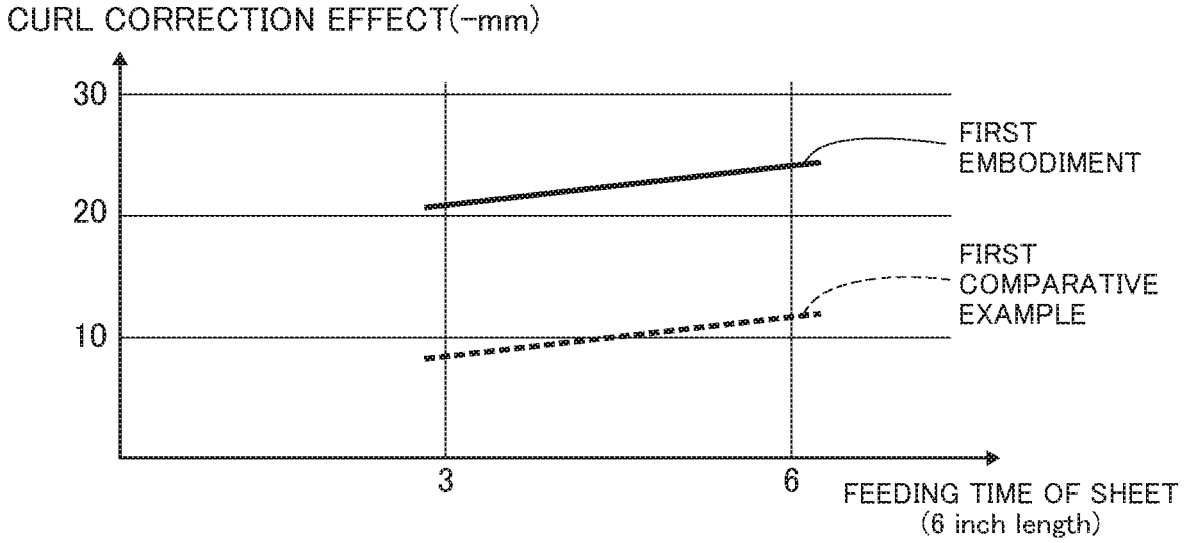
FIG. 9 is a graph showing results of confirmation test of the curl correction effect.

FIG. 9 is a graph showing results of confirmation test of the curl correction effect. The results of confirmation test of the curl correction effect will be described hereinafter with reference to FIG. 9.

The curl corrector 40 in the first embodiment has the curvature radius of 12.5 [mm] at the curl correction route (i.e., decurl curvature A is 1/12.5 [mm]) and the decurl angle B of 100 degrees. The curl corrector of the first comparative example has the curvature radius of 12.5 [mm] (i.e., decurl curvature A is 1/12.5 [mm]) and the decurl angle B of 45 degrees.

The curl correction effect was confirmed by measuring the curl height (i.e., height of curled sheet) after passing a sheet S, which has a length of 6 [inch], a width of 2 [inch], and a curl height of 42 [mm], through the curl corrector.

The curl correction effect was confirmed with the sheet S that passed through the curl corrector in 3 seconds and with the sheet S that passed through the curl corrector in 6 seconds. In other words, the curl correction effect was confirmed by setting the paper stay time t as 3 seconds and as 6 seconds.

As shown in FIG. 9, the curl height of the sheet S that passed through the curl corrector 40 of the first embodiment in 3 seconds was reduced by 21 mm. The curl height of the sheet S that passed through the curl corrector 40 of the first embodiment in 6 seconds was reduced by 24 mm.

In the first comparative example, the curl height of the sheet S that passed through the curl corrector in 3 seconds was reduced by 8 mm, and the curl height of the sheet S that passed through the curl corrector in 6 seconds was reduced by 12 mm.

Figure 10:
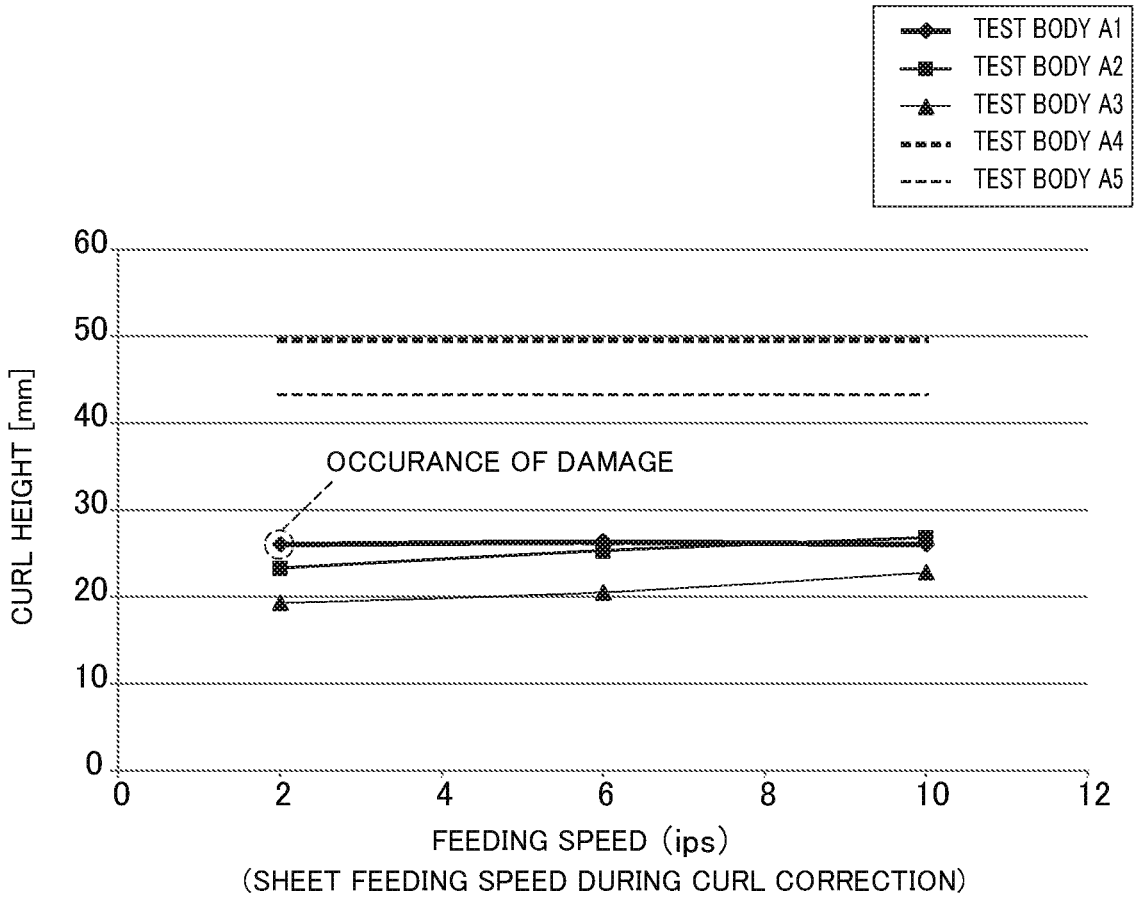
FIG. 10 is a graph showing results of another confirmation test of the curl correction effect.

FIG. 10 is a graph showing results of another confirmation test of the curl correction effect. The results of this confirmation test of the curl correction effect will be described hereinafter with reference to FIG. 10.

In this test, the curl correction route has the curvature radius of 8.5 [mm] (i.e., decurl curvature is 1/8.5 [mm]). The image printed thereon was a solid white image and had a gloss finish. The size of the printed image was 4 [mm]×6 [mm].

In FIG. 10, the horizontal axis shows the feeding speeds [ips] of the sheet S during the curl correction, and the vertical axis shows absolute values of the curl heights [mm]. A test body A1 is a sheet S to which the curl correction process was applied before forming the image of yellow Y (i.e., before printing). A test body A2 is a sheet S to which the curl correction process was applied before forming the overcoat OP (i.e., before transcription). A test body A3 is a sheet S to which the curl correction process was applied after forming the overcoat OP (i.e., after transcription). A test body A4 is a sheet S to which the curl correction process was applied without forming any image. A test body A5 is a sheet S on which an image was formed but no curl correction process was applied thereto.

With the test body A1, the curl height was 26 [mm] when the feeding speed of the sheet S was 2 [ips], the curl height was 26 [mm] when the feeding speed of the sheet S was 6 [ips], and the curl height was 26 [mm] when the feeding speed of the sheet S was 10 [ips].

With the test body A2, the curl height was 24 [mm] when the feeding speed of the sheet S was 2 [ips], the curl height was 25 [mm] when the feeding speed of the sheet S was 6 [ips], and the curl height was 27 [mm] when the feeding speed of the sheet S was 10 [ips].

With the test body A3, the curl height was 19 [mm] when the feeding speed of the sheet S was 2 [ips], the curl height was 20 [mm] when the feeding speed of the sheet S was 6 [ips], and the curl height was 23 [mm] when the feeding speed of the sheet S was 10 [ips].

With the test body A4, the curl height was 43 [mm] regardless of the feeding speed of the sheet S. With the test body A5, the curl height was 49 [mm] regardless of the feeding speed of the sheet S.

The results show that the curl correction effect is recognized regardless of the feeding speed when the sheet S is fed to the curl corrector 40 before printing. The results also show that the slower the feeding speed, the curl correction effect becomes greater when the sheet S is fed to the curl corrector 40 after printing. The results also show that the curl correction effect becomes greater when the sheet S is fed to the curl corrector 40 after forming the overcoat OP compared to the curl correction effect when the sheet S is fed to the curl corrector 40 before forming the overcoat OP.

The operation of the printer of the first embodiment will be described. The printer 1 of the first embodiment includes the first route X1, to which the sheet S from the roll paper R is fed; the drive roller 21, which is arranged on the first route X1 and capable of sending the sheet S in the feeding direction D1 and in the pullback direction D2; the image forming part (thermal printer head 5), which is arranged on the first route X1 and forms an image on the sheet S; the second route X2 branched from the first route X1; the route changer 30, which switches the route of the sheet S between the first route X1 and the second route X2; the curl corrector 40, which is provided on the second route X2 to correct curl in the sheet S; and the cutter (cutting unit 7), which is provided on the first route X1 to cut the sheet S. The curl corrector 40 forms the route having a predetermined curvature radius with the curl correction roller 41 and the guide member 42 positioned to face the curl correction roller 41. With this, the advancing direction of the sheet S is changed by 100 degrees or more when the sheet S passes through the curl corrector 40 (see FIG. 3).

As a result, the correction amount of the curl in the sheet S corrected by the curl corrector 40 increases. Accordingly, it is possible to improve the curl correction effect of the sheet S by increasing the curvature radius in the route at the curl corrector 40 while avoiding damaging the sheet S with wrinkles and/or folds.

For example, with a photo sheet as the sheet S, if the curvature radius in the curl correction routes is smaller than 12.5 [mm], the sheet S may be damaged with wrinkles and/or folds due to an increase in the friction on the sheet S at the curl corrector 40. With the first embodiment, since the curvature radius in the route of the sheet S at the curl corrector 40 can be increased, it is possible to improve the curl correction effect on the sheet S without damaging the sheet S with wrinkles and/or folds even when a photo sheet is used as the sheet S.

The feeding of the sheet S is temporally stopped when the sheet S is cut by the cutter (cutting unit 7). However, if the feeding of the sheet S is stopped while the sheet S is left in the curl corrector 40, the sheet S may be damaged with wrinkles and/or folds. To this end, the curl corrector 40 of the first embodiment is provided in the second route X2 where the cutter (cutting unit 7) does not exist. With this, when the feeding of the sheet S is temporally stopped to cut the sheet S by the cutter (cutting unit 7), the sheet S is not left in the curl corrector 40. Therefore, it is possible to prevent the sheet S from being damaged with wrinkles and/or folds.

The sheet S fed to the second route X2 is further fed in the feeding direction D1 and then sent in the pullback direction D2. That is, the sheet S passes through the curl corrector 40 twice (i.e., when the sheet S is fed in the feeding direction D1 and when the sheet S is sent in the pullback direction D2). As a result, it is possible to improve the curl correction effect by sending the sheet S to the second route X2 twice.

With the printer 1 of the first embodiment, the drive roller 21 can vary the feeding speed of the sheet S when sending the sheet S to the second route X2 (FIG. 3).

Accordingly, it is possible to modify the time for which the sheet S passes through the curl corrector 40. The slower the time for which the sheet S passes through the curl corrector 40, the curl correction effect becomes greater. Additionally, the curl amount of the sheet S differs depending on, for example, the storage period of the roll paper R and/or the wound position (inner side or outer side) of the sheet S in the roll paper R. That is, the curl amount of the sheet S increases as the storage period of the roll paper R increases. Further, the curl amount of the sheet S increases as the position where the sheet S is wound goes inside. Also, the curl amount of the sheet S differs depending on the color of the image printed on the sheet S. For example, the sheet S formed with a black image has better curl correction effect than the sheet S formed with a white image.

Thus, the speed to send the sheet S in the second route X2 is adjusted in accordance with the curl amount of the sheet S and/or the color of the image formed on the sheet S. As a result, it is possible to prevent overcorrection of the curl in the sheet S and to straighten the sheet S.

In the printer 1 of the first embodiment, at least one of the curl correction roller 41 or the guide member 42 is movable relatively to the other.

With this, it is possible to change the curvature of the route of the sheet S at the curl corrector 40. The curl correction effect improves as the curvature of the route of the sheet S at the curl corrector 40 increases. Therefore, it is possible to straighten or flat the sheet S by adjusting the curvature of the route of the sheet S at the curl corrector 40 in accordance with the curl amount of the sheet S and/or the color of the image formed on the sheet S.

Here, the relative distance of the curl correction roller 41 and the guide member 42 may be reduced to correct the curl in the sheet S sent to the second route X2 only when the sheet S is fed in the feeding direction D1 or when the sheet S is sent in the pullback direction D2. Alternatively, the curl in the sheet S may be corrected when the sheet S is fed in the feeding direction D1 and when the sheet S is sent in the pullback direction D2. Accordingly, it is possible to straighten the sheet S by selecting the number of the curl corrections in accordance with the curl amount of the sheet S and/or the color of the image formed on the sheet S. It should be noted that the curl correction process may be skipped when the curl amount of the sheet S is relatively small.

In the printer 1 of the first embodiment, the route changer 30 can switch the timing for sending the sheet S to the second route X2 between before an image is formed on the sheet S with the image forming part (i.e., thermal printer head 5) and after an image is formed on the sheet S with the image forming part (i.e., thermal printer head 5).

With this, the user of the printer 1 can select the timing of the curl correction before or after an image is formed on the sheet S. Here, the curl correction effect is greater when the curl correction process is carried out after forming an image on the sheet S rather than the curl correction process is carried out before forming an image on the sheet S. Accordingly, it is possible to straighten the sheet S by changing the timing of the curl correction in accordance with the curl amount of the sheet S and/or the color of the image formed on the sheet S.

Second Embodiment

In a printer of the second embodiment, the position of a second route and the position of an ejection port for ejecting a sheet are different from those of the printer of the first embodiment.

Figure 11:
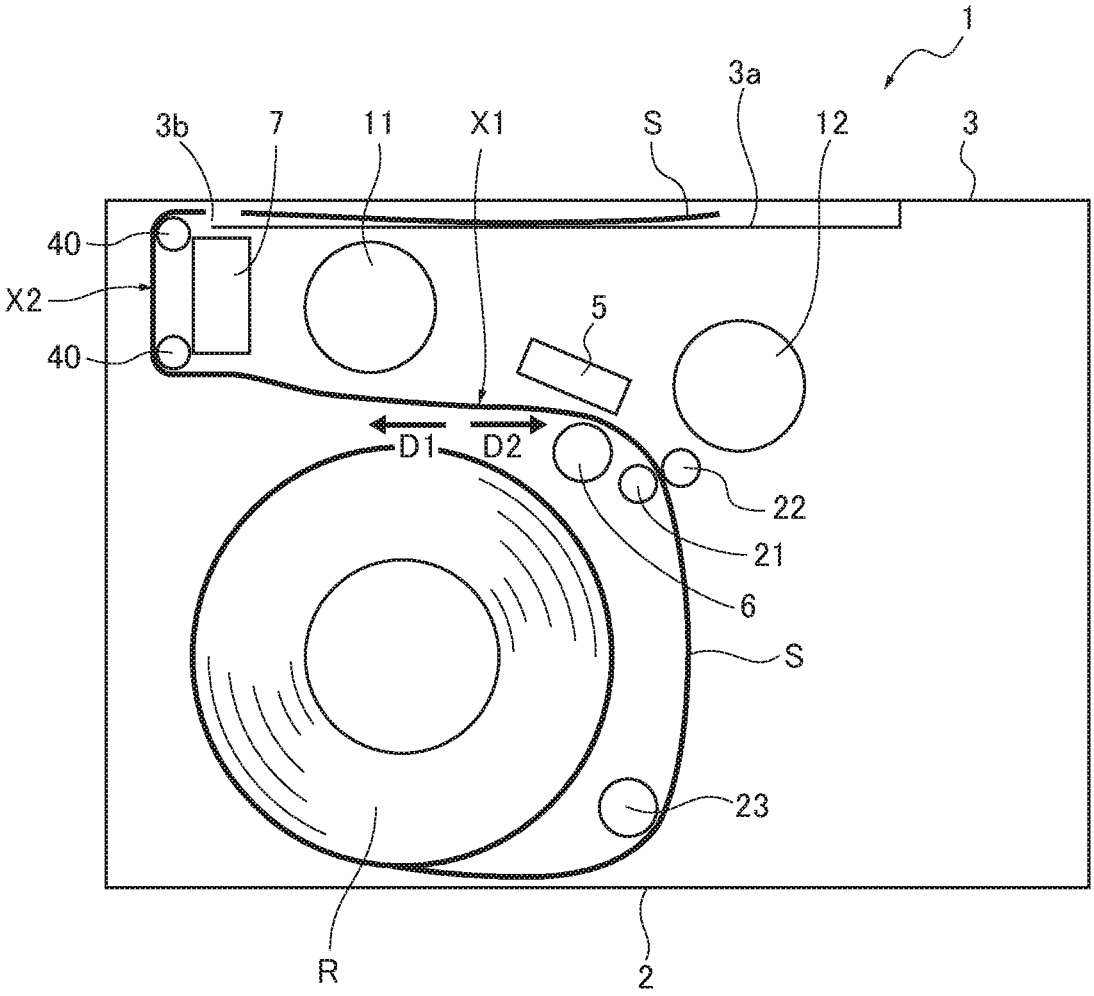
FIG. 11 is a cross-sectional view illustrating a printer of the second embodiment.
Figure 12:
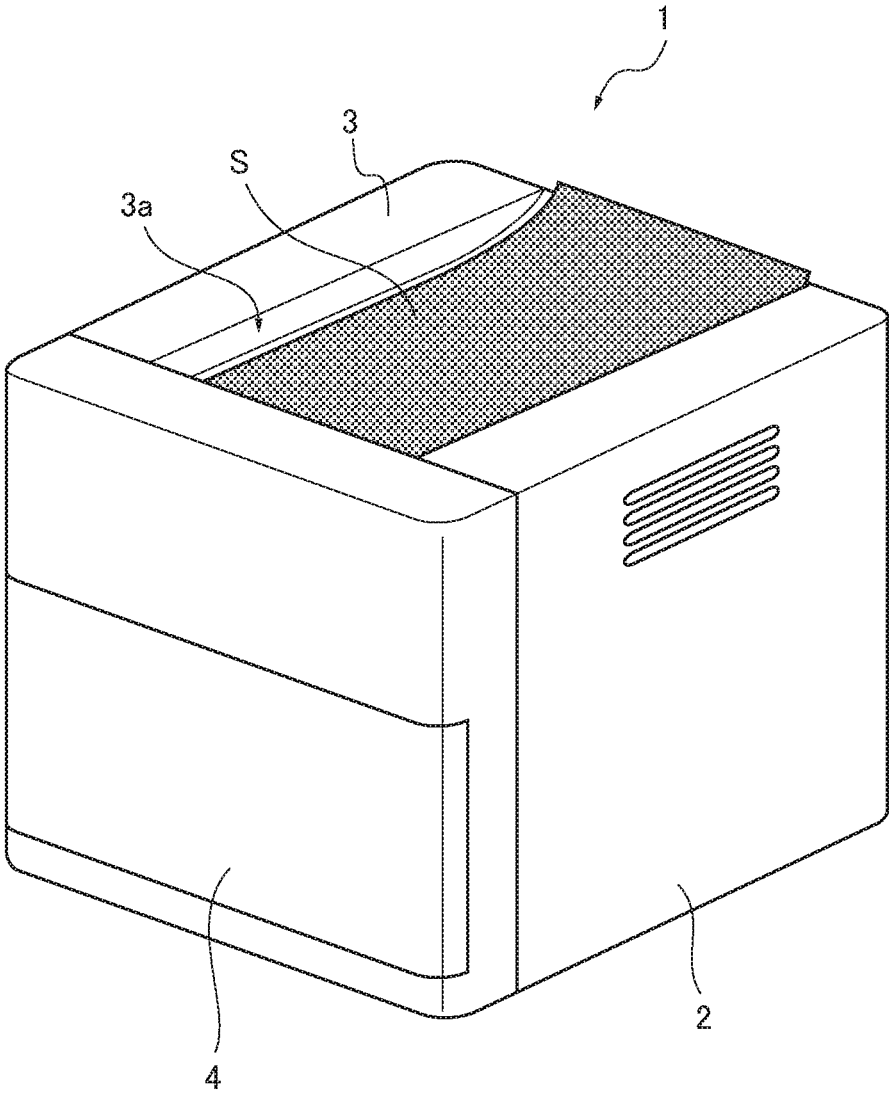
FIG. 12 is a perspective view illustrating the printer of the second embodiment.

FIG. 11 is a cross-sectional view illustrating the printer of the second embodiment. FIG. 12 is a perspective view illustrating the printer of the second embodiment. Hereinafter, the configuration of the printer of the second embodiment will be described with reference to FIG. 11 and FIG. 12. It should be noted that the same terminologies and the same reference numerals are used for the elements identical or equivalent to the first embodiment.

As shown in FIG. 11, the second route X2 of the printer 1 of the second embodiment is arranged downstream of the first route X1 in the feeding direction of the sheet S. The second route X2 is connected to the ejection port 3*b* for ejecting the sheet S.

As shown in FIG. 11 and FIG. 12, the top cover 3 has a recessed part 3*a* and the ejection port 3*b* for the sheet S. That is, the recessed part 3*a* and the ejection port 3*b* are provided on the top of the printer 1.

The recessed part 3*a* has a recessed shape with a width larger than the width of the sheet S. The sheet S ejected from the ejection port 3*b* is placed on the recessed part 3*a* on the top cover 3 of the printer 1.

There are two curl correctors 40 along the second route X2. However, the number of the curl correctors 40 may be one or more than two.

The printer 1 of the second embodiment includes the first route X1, to which the sheet S from the roll paper R is fed; the drive roller 21, which is arranged on the first route X1 and capable of sending the sheet S in the feeding direction D1 and in the pullback direction D2; the image forming part (thermal printer head 5), which is arranged on the first route X1 and forms an image on the sheet S; the second route X2, which is provided downstream of the first route X1 in the feeding direction D1 and is connected to the ejection port 3*b* on the top of the printer 1; and the curl corrector 40, which is provided on the second route X2 to correct curl in the sheet S. The curl corrector 40 forms the route having a predetermined curvature radius by the curl correction roller 41 and the guide member 42 positioned to face the curl correction roller 41. With this, the advancing direction of the sheet S is changed by 100 degrees or more when the sheet S passes through the curl corrector 40 (see FIG. 11).

As a result, the sheet S is ejected to the top of the housing 2 of the printer 1. That is, the top surface of the printer 1 can be used as a tray. Therefore, it can eliminate the need for providing a separate tray. Further, it is possible to correct curl in the sheet S which has been formed with an image and cut by the cutter. Consequently, the transport time of the sheet S can be shortened.

It should be noted that other configurations, functions and effect of the second embodiment are substantially identical to those of the first embodiment, and therefore the description thereof is omitted.

Third Embodiment

A printer of the third embodiment is different from the printer of the first embodiment in that the printer includes a curl correction amount adjuster.

Figure 13:
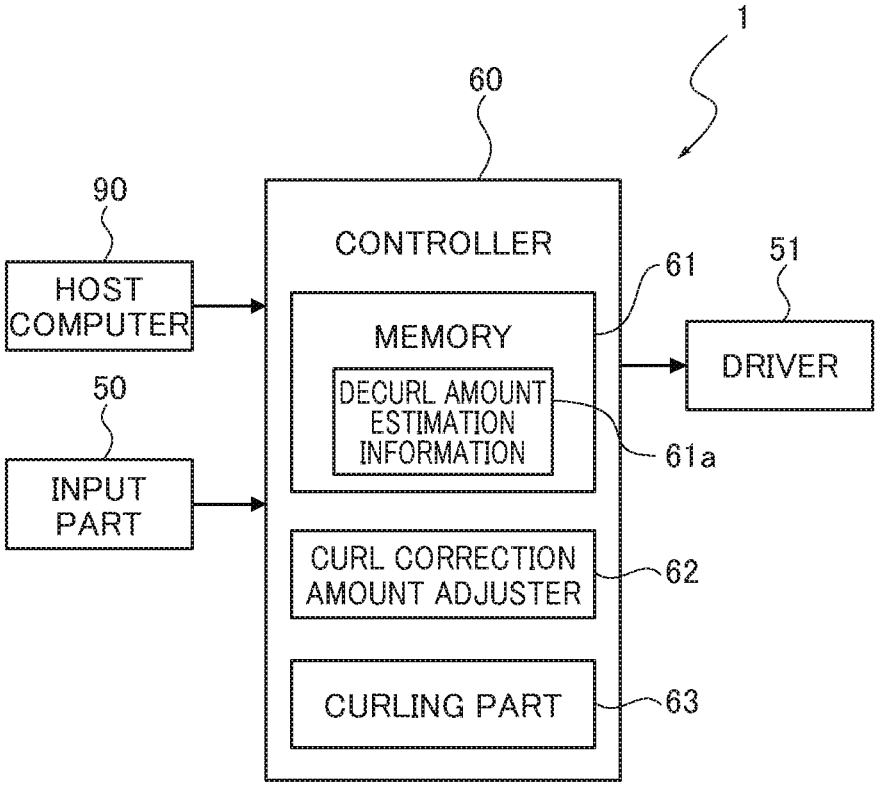
FIG. 13 is a block diagram showing functional configuration of a printer of the third embodiment.
Figure 14:
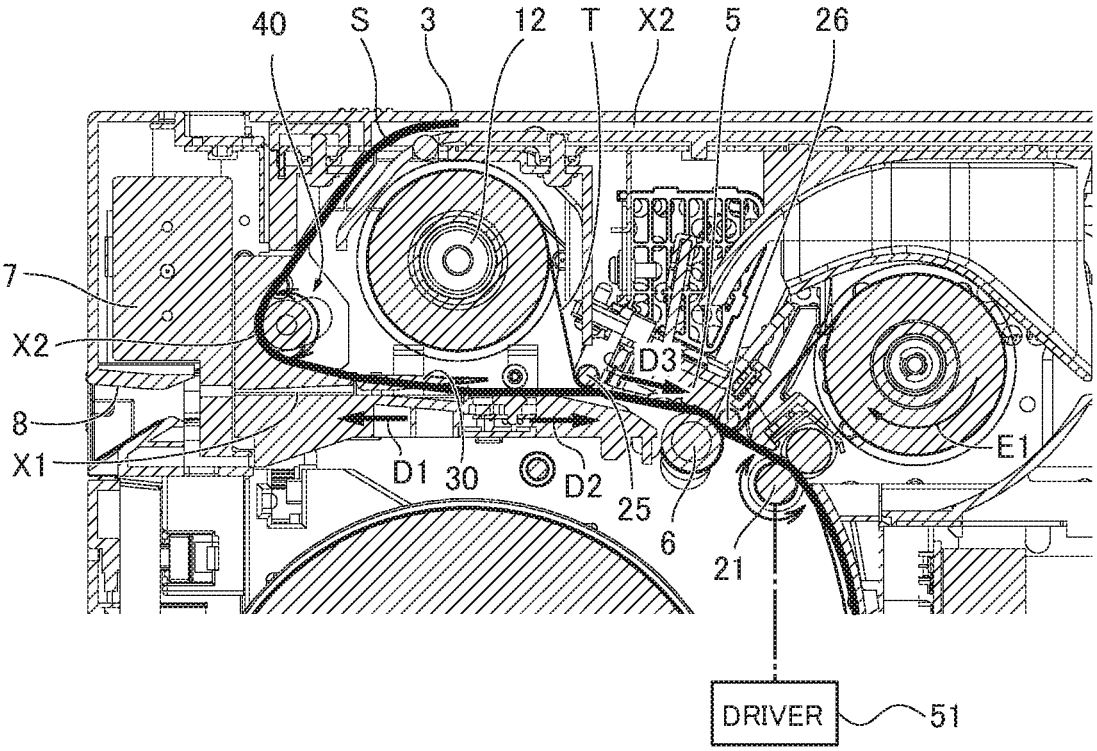
FIG. 14 is an explanatory view for explaining a feeding amount of a sheet adjusted by a curl correction amount adjuster of the third embodiment.
Figure 15:
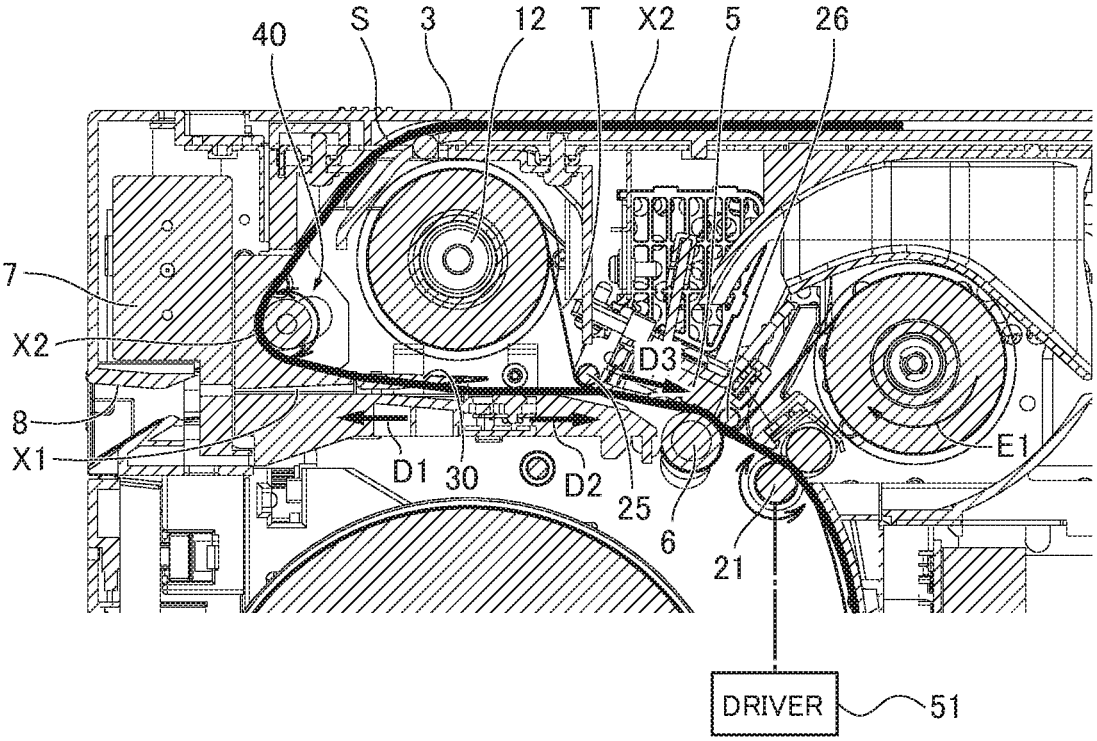
FIG. 15 is an explanatory view for explaining the feeding amount of the sheet adjusted by the curl correction amount adjuster of the third embodiment.

FIG. 13 is a block diagram showing functional configuration of the printer of the third embodiment. FIG. 14 and FIG. 15 are explanatory views for explaining a feeding amount of a sheet adjusted by the curl correction amount adjuster of the third embodiment. Hereinafter, the function and configuration of the printer of the third embodiment will be described with reference to FIGS. 13-15. It should be noted that the same terminologies and the same reference numerals are used for the elements identical or equivalent to the first embodiment.

As factors that cause the sheet S to curl, influence such as a type of roll paper R, a winding diameter of the roll paper R (outside diameter and inside diameter), and the age of the roll paper R can be considered. The curl amount of the sheet S after printing is relatively small with a relatively new roll paper R, with matte finish, or with high-density printing such as a solid black image. Therefore, if the curl correction process is carried out uniformly, the sheet S may be warped backward.

As shown in FIG. 13, the printer 1 of the third embodiment includes a host computer 90, an input part 50, a controller 60, and a driver 51.

The host computer 90 records information such as date and time when the roll paper R was replaced, a usage amount of the roll paper R (e.g., number of sheets S having predetermined length), and a type of the roll paper R. The types of the roll paper R include, for example, standard (SD) paper and high quality (PD) paper. Here, a standard paper corresponds to a plain paper.

Through the input part 50, the user can input, for example, a setting of the overcoat and a command for a high-density printing. The setting of the overcoat includes gloss finish and matte finish.

The controller 60 includes a memory 61 and a curl correction amount adjuster (decurl amount adjuster) 62. The memory 61 records decurl amount estimation information 61*a*. Table 1 shows the decurl amount estimation information in the third embodiment.

sheet S (predetermined length sheet S). That is, the greater the values, the amount by which the sheet S is fed to the curl corrector 40 increases.

For example, if the usage amount of the roll paper R (e.g., number of predetermined length sheets S used) is five (5), the overcoat setting is gloss finish, the roll paper R is the high quality (PD) paper, and the age of the roll paper is not relatively long; the curl amount of the sheet S is not relatively large. Thus, the curl correction amount is estimated to be small and represented with the value four (4).

If the usage amount of the roll paper R (e.g., number of predetermined length sheets S used) is one hundred (100), the overcoat setting is gloss finish, the roll paper R is the high quality (PD) paper, and the age of the roll paper is not relatively long; the curl amount of the sheet S is larger than that of the sheet whose usage amount is five (5). Thus, the curl correction amount is represented by the value eight (8).

If the usage amount of the roll paper R (e.g., number of predetermined length sheets S used) is five (5), the overcoat setting is gloss finish, the roll paper R is the high quality (PD) paper, and the age of the roll paper is considerably long; the curl amount of the sheet S is larger than that of a new roll paper R. Thus, the curl correction amount is represented by the value six (6).

If the usage amount of the roll paper R (e.g., number of predetermined length sheets S used) is one hundred (100), the overcoat setting is gloss finish, the roll paper R is the high quality (PD) paper, and the age of the roll paper is considerably long; the curl amount of the sheet S is larger than that of a new roll paper R. Thus, the curl correction amount is represented by the value ten (10).

TABLE 1

| | | OVERCOAT SETTING | | | | | | | |
|---|---|---|---|---|---|---|---|---|---|
| | | GLOSS FINISH MEDIA TYPE | | | | | | | |
| | | SD (STANDARD) AGE | | | PD (HIGH-QUALITY) AGE | | | MATTE | HIGH-DENSITY |
| | | NEW | INTERMEDIATE | OLD | NEW | INTERMEDIATE | OLD | FINISH | PRINTING |
| ROLL DIAMETER (USAGE AMOUNT) | 1-30 | 6 | 7 | 8 | 4 | 5 | 6 | ○ NO CURL CORRECTION (NO DECURL) | ○ NO CURL CORRECTION (NO DECURL) |
| | 31-50 | 7 | 8 | 9 | 5 | 6 | 7 | | |
| | 51-70 | 8 | 9 | 10 | 6 | 7 | 8 | | |
| | 71-90 | 9 | 10 | 10 | 7 | 8 | 9 | | |
| | 91-110 | 10 | 10 | 10 | 8 | 9 | 10 | | |
| | 110- | 10 | 10 | 10 | 9 | 10 | 10 | | |

As shown in Table 1, the decurl amount estimation information 61*a* represents the curl correction amount (i.e., decurl amount) with numerical values. The decurl amount estimation information is estimated based on the usage amounts of the roll papers R, the setting of the overcoat, the types of the roll papers (medias) R, the ages of the roll papers R, and the presence/absence of the high-density printings.

The curl correction amount is an amount by which the sheet S is fed to the curl corrector 40. The value one (1) means that the amount by which the sheet S is fed to the curl corrector 40 is small. The value five (5) means that the amount by which the sheet S is fed to the curl corrector 40 corresponds to about a half-length of the single sheet S (predetermined length sheet S). The value ten (10) means that the amount by which the sheet S is fed to the curl corrector 40 corresponds to the entire length of the single If the roll paper R is the standard (SD) paper, the curl amount is larger than that of the high quality (PD) paper.

In the case of matte finish or in the case of high-quality printing, the value representing the curl amount of the sheet S may be set to zero (0) and skip the curl correction process (i.e., decurl process).

The curl correction amount adjuster 62 refers to the decurl amount estimation information 61*a* based on the information from the host computer 90 and determines the value 0-10. The curl correction amount adjuster 62 sends the feeding amount corresponding to the determined value 0-10 to the driver 51.

The driver 51 feeds the sheet S to the curl corrector 40 based on the value 0-10 sent from the curl correction amount adjuster 62.

For example, when the value sent from the curl correction amount adjuster 62 is six (6), the driver 51 drives the drive roller 21 to feed the sheet S to the curl corrector 40 in the middle (by six tenth) of one single sheet S (i.e., predetermined length sheet S), as shown in FIG. 14.

When the value sent from the curl correction amount adjuster 62 is ten (10), the driver 51 drives the drive roller 21 to feed the sheet S to the curl corrector 40 by one single sheet (i.e., predetermined length sheet S), as shown in FIG. 15.

Figure 16:
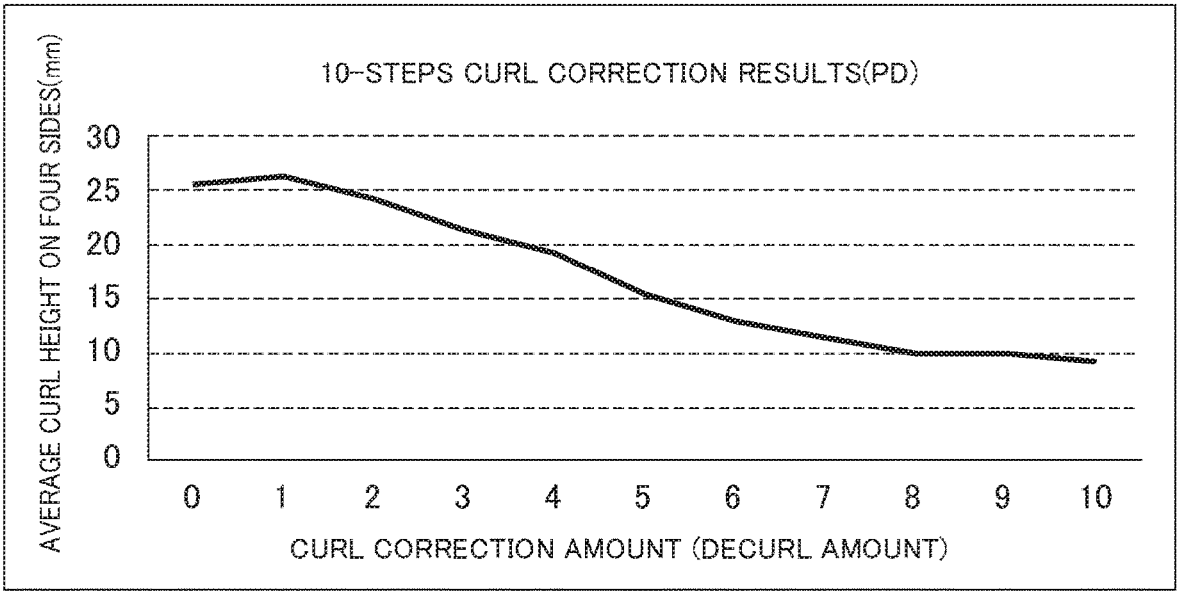
FIG. 16 is a graph showing the curl correction effect for a high-quality paper in the third embodiment.
Figure 17:
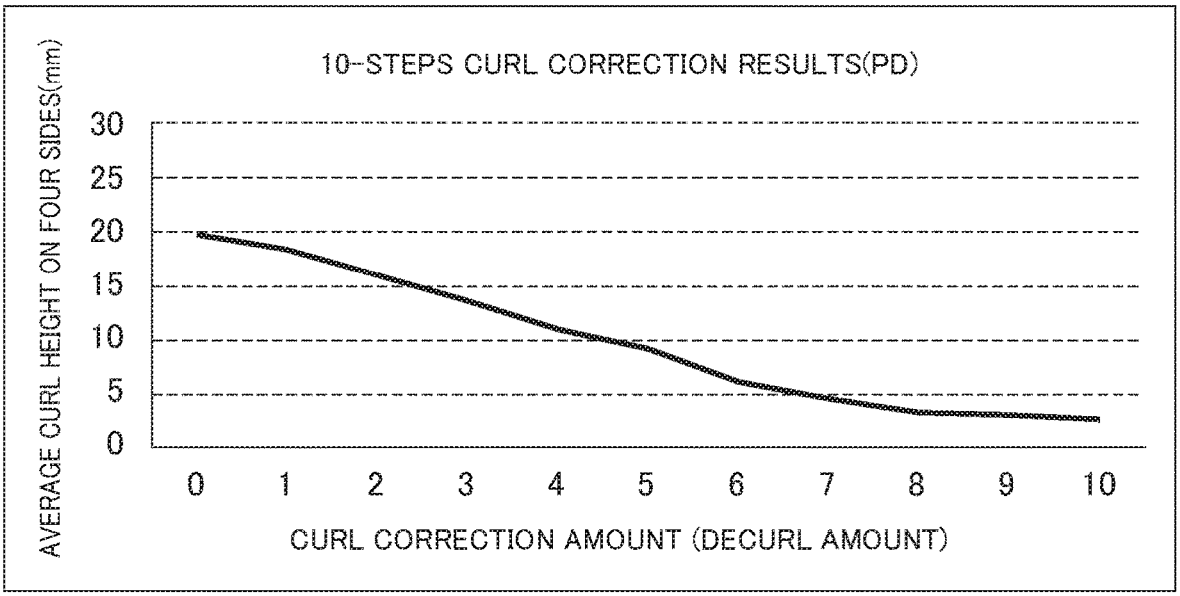
FIG. 17 is a graph showing the curl correction effect for a plain paper in the third embodiment.
Figure 18:
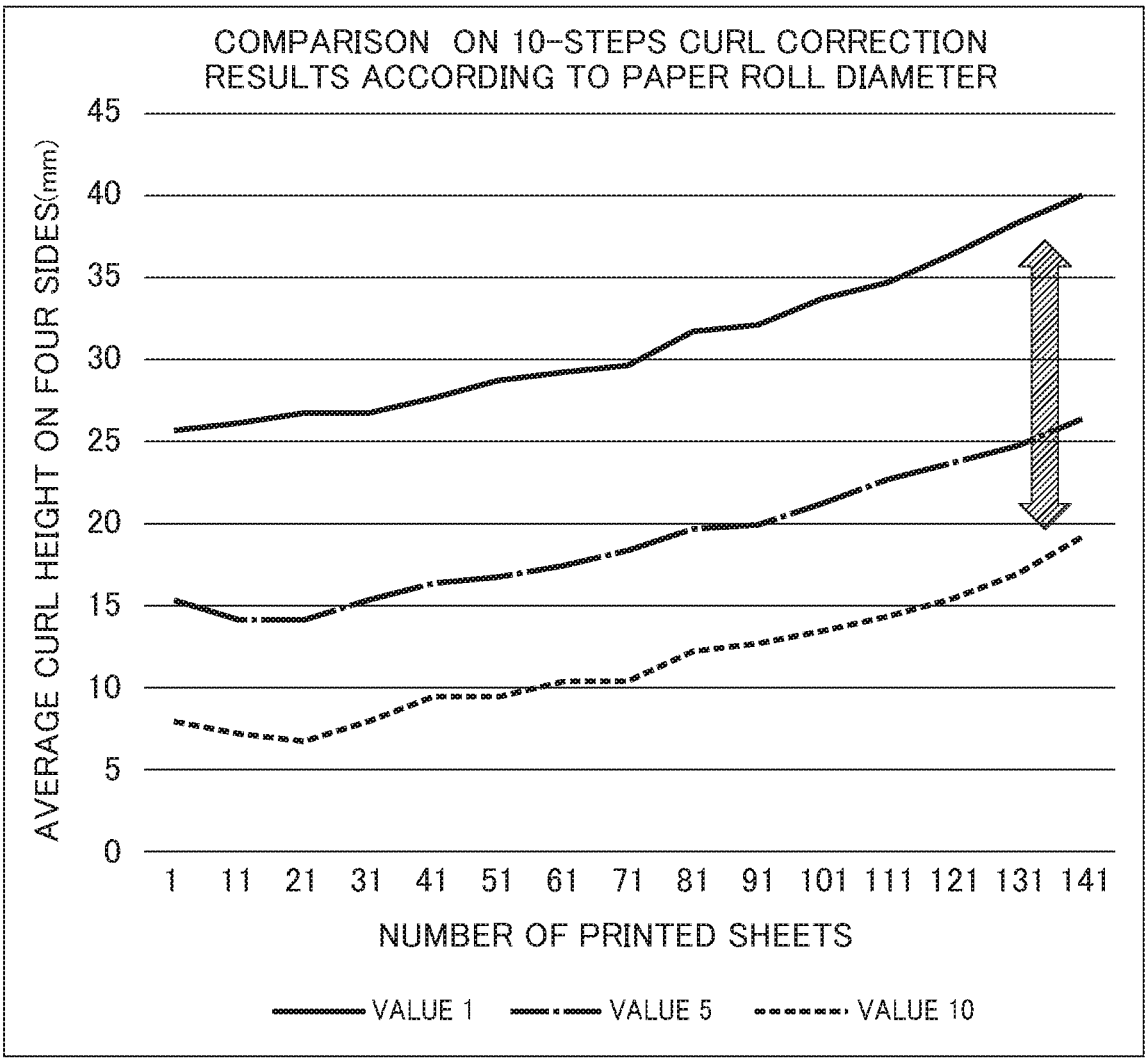
FIG. 18 is a graph showing the curl correction effects depending on diameters of roll papers in the third embodiment.

FIG. 16 is a graph showing the curl correction effect for a high-quality paper in the third embodiment. FIG. 17 is a graph showing the curl correction effect for a plain paper in the third embodiment. FIG. 18 is a graph showing the curl correction effects depending on diameters of roll papers in the third embodiment. Hereinafter, the curl correction effect of the third embodiment will be described with reference to FIGS. 16-18.

As shown in FIG. 16, with a high quality paper, when the value was zero (0), the curl height of the sheet S which had been fed to the curl corrector 40 and ejected from the ejection port 8 was about 26 [mm]. When the value was five (5), the curl height of the sheet S which had been fed to the curl corrector 40 and ejected from the ejection port 8 was about 15 [mm]. When the value was ten (10), the curl height of the sheet S which had been fed to the curl corrector 40 and ejected from the ejection port 8 was about 9 [mm].

As shown in FIG. 17, with a standard paper (i.e., plain paper), when the value was zero (0), the curl height of the sheet S which had been fed to the curl corrector 40 and ejected from the ejection port 8 was about 20 [mm]. When the value was five (5), the curl height of the sheet S which had been fed to the curl corrector 40 and ejected from the ejection port 8 was about 8 [mm]. When the value was ten (10), the curl height of the sheet S which had been fed to the curl corrector 40 and ejected from the ejection port 8 was about 3 [mm].

With a high quality paper, if the sheet S having the curl height of, for example, 10 [mm] is fed to the curl corrector 40 by one single sheet (i.e., predetermined length sheet S), the sheet S passed through the curl corrector 40 would be warped backward as the curl correction effect is about 16 [mm]. Here, "warped backward" means that the sheet S is warped in the direction opposite to the winding direction in the roll paper R.

With a standard paper (i.e., plain paper), if the sheet S having the curl height of, for example, 10 [mm] is fed to the curl corrector 40 by one single sheet (i.e., predetermined length sheet S), the sheet S passed through the curl corrector 40 would be warped backward as the curl correction effect is about 17 [mm].

The values of the decurl amount estimation information 61*a* are determined such that the sheet S are not warped backward.

As shown in FIG. 18, when the value was one (1) and the usage amount was one (i.e., diameter of roll paper R was relatively large), the curl height of the sheet S after passing through the curl corrector 40 was about 26 [mm]. When the value was one (1) and the usage amount was fifty (i.e., diameter of roll paper was decreased), the curl height of the sheet S after passing through the curl corrector 40 was about 28 [mm]. When the value was one (1) and the usage amount was one hundred (i.e., diameter of roll paper was relatively small), the curl height of the sheet S after passing through the curl corrector 40 was about 33 [mm].

When the value was five (5) and the usage amount was one (i.e., diameter of roll paper R was relatively large), the curl height of the sheet S after passing through the curl corrector 40 was about 15 [mm]. When the value was five (5) and the usage amount was fifty (i.e., diameter of roll paper R was decreased), the curl height of the sheet S after passing through the curl corrector 40 was about 17 [mm]. When the value was five (5) and the usage amount was one hundred (i.e., diameter of roll paper R was relatively small), the curl height of the sheet S after passing through the curl corrector 40 was about 22 [mm].

When the value was ten (10) and the usage amount was one (i.e., diameter of roll paper R was relatively large), the curl height of the sheet S after passing through the curl corrector 40 was about 8 [mm]. When the value was ten (10) and the usage amount was fifty (i.e., diameter of roll paper R was decreased), the curl height of the sheet S after passing through the curl corrector 40 was about 9 [mm]. When the value was ten (5) and the usage amount was one hundred (i.e., diameter of roll paper R was relatively small), the curl height of the sheet S after passing through the curl corrector 40 was about 14 [mm].

The results show that the smaller the diameter of the roll paper R is, the curl height of the sheet S after passing through the curl corrector 40 becomes larger regardless of the values 1-10. The values of the decurl amount estimation information 61*a* are therefore determined by taking the diameters of the roll paper R in consideration such that the sheets S are not warped backward.

When the value of the curl correction amount is ten (10), the front end of the sheet S for a next image is also fed to the curl corrector 40. At this time, the front end of the sheet S for the next image is in a state before the overcoat transcription. Therefore, the sheet S for the next image may be damaged by wrinkles and/or folds. To this end, the value of the curl correction amount may be set to nine (9) such that only the sheet S after the overcoat transcription is fed to the curl corrector 40, thereby preventing wrinkles and/or folds on the sheet S.

When the curl height is relatively high, it may be difficult to feed the sheet S to the curl correction roller 41, causing the sheets S to be folded. That is, regardless of the presence or absence of the overcoat transcription, wrinkles may occur at a position about 15 [mm] from the front end of the sheet S.

When the value of the curl correction amount is set to 10 (ten) in the previous image formation, wrinkles may occur at a position about 10 [mm] from the front end of the sheet S. However, the curl height at the front end of the sheet S can be lowered. As a result, it becomes possible to smoothly feed the sheet S to the curl correction roller 41 such that wrinkles would not occur at the position about 15 [mm] from the front end of the sheet S.

Therefore, the part 10 [mm] from the front end of the sheet S, where the wrinkles have occurred, is removed from the sheet S by carrying out the 5.5 [mm] cutting process twice, which is usually carried out once. When the value of the curl correction amount is nine (9), the position about 5 [mm] from the front end of the sheet S for the next image has wrinkles. However, such a part is removed as cutting waste.

Here, the curl correction process after the overcoat transcription would not create wrinkles and/or folds as the sheet S has been coated.

The operation of the printer of the third embodiment will be described. The printer 1 of the third embodiment includes the curl correction amount adjuster 62 capable of adjusting the curl correction amount by adjusting the feeding amount by which the sheet S is fed to the curl corrector 40 (FIG. 13).

With this, it is possible to improve the curl correction effect by increasing the feeding amount of the sheet to be fed to the curl corrector 40 when the curl height is relatively high. On the other hand, it is possible to prevent the sheet S from being warped backward due to overcorrection of the curl by decreasing the feeding amount of the sheet S to be fed to the curl corrector 40 when the curl height is relatively low. Accordingly, it is possible to carry out the optimal curl correction in accordance with the curl heights.

It should be noted that other configurations, functions and effect of the third embodiment are substantially identical to those of the above-described embodiments, and therefore the description thereof is omitted.

Fourth Embodiment

A printer of the third embodiment is different from the printer of the first embodiment in that the printer includes a curling part.

Figure 19:
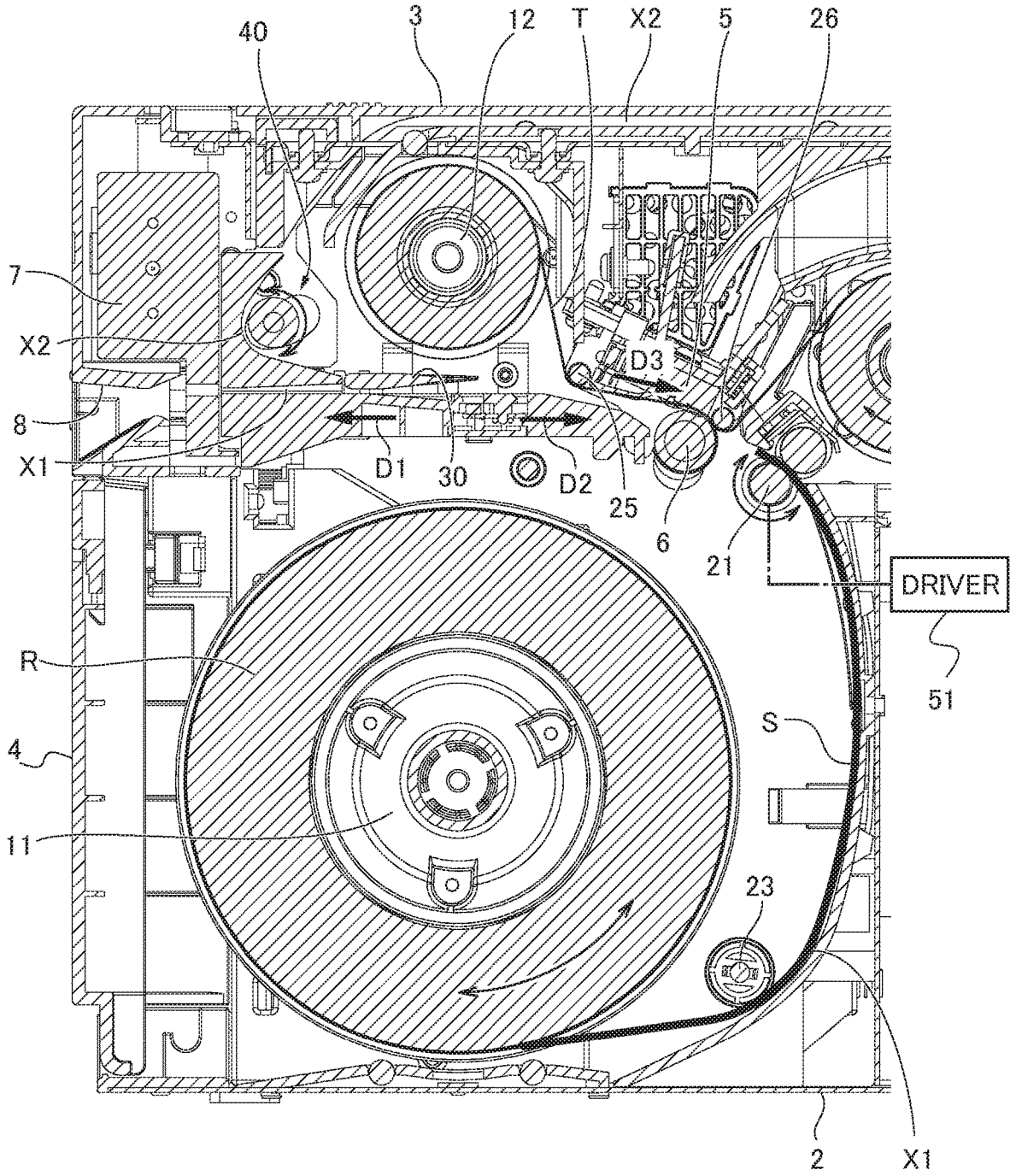
FIG. 19 is an explanatory view for explaining movements of the sheet generated by a curling part of the fourth embodiment.

FIG. 19 is an explanatory view for explaining movements of a sheet generated by the curling part of the fourth embodiment. It should be noted that the same terminologies and the same reference numerals are used for the elements identical or equivalent to the first embodiment.

As shown in FIG. 13, the controller 60 includes the curling part 63. The curling part 63 inputs a command to the driver 51 such that the sheet S which has been sent to the curl corrector 40 and straightened is sent in the pullback direction D2 and passes through the drive roller 21 by a predetermined length (e.g., the portion where the curl is corrected by the curl corrector 40 is sent in the pullback direction D2 and passes through the drive roller 21).

As shown in FIG. 19, the drive roller 21 is configured as a grip roller having a friction force against the sheet S. The outer peripheral surface of the grip roller is formed of an elastic body to have the friction force against the sheet S. Alternatively, the grip roller may have a plurality of protrusions protruding in the outer peripheral direction to have a friction force against the sheet S.

When the sheet S passes through the drive roller 21, the sheet S is fed so as to be wound around the drive roller 21 due to the friction force (grip force) of the drive roller 21 against the sheet S. With this configuration, the drive force is configured as a curling roller. Here, the diameter of the drive roller 21 is substantially identical to the diameter of the curl correction roller 41.

In the printer 1 configured as described above, the sheet S is fed in the feeding direction D1, passed through the curl corrector 40 to correct the curl in the sheet S, sent in the pullback direction D2, and guided to the drive roller 21.

As the sheet S is fed so as to be wound around the drive roller 21, the curling process is applied to the sheet S whose curl has been corrected. The sheet S is then fed in the feeding direction D1, passes through the drive roller 21 to be further curled, and ejected from the ejection port 8.

As described above, the curling process in which the sheet S passes through the drive roller 21 is carried out after the curl correction process.

An image having an effect with the curling part 63 is an image that has a high curl correction effect at upstream of the image but has a low curl correction effect at downstream thereof. An example of such an image is an image having a black solid image (high density image) on the upper part and having a white solid image on the lower part. On the other hand, if an image having a white solid image on the upper part and having a black solid image on the lower part is input to the controller 60 from the input part 50, the controller 60 automatically recognizes the image and forms the image upside down. As a result, the effect applied by the curling part 63 becomes effective to the image.

Even for other images, it is possible to obtain a sheet S with a uniform curl by passing the entire sheet S (sheet S having predetermined length) through the drive roller 21 and applying the curling process to the entire sheet S if it is unavoidable for the sheet S to pass through the drive roller 21 to pull back the sheet S from the curl corrector 40 due to the structure of the printer in response to the command from the curling part 63.

Alternatively, by having the route distance between the curl corrector 40 and the drive roller 21 (i.e., curling roller) longer than the entire length of one single sheet S (sheet S having predetermined length), it is possible not to curl the sheet S when the sheet S is pulled back from the curl corrector 40. With this, a printer 1 having a higher curl correction effect can be provided.

The operation of the printer of the fourth embodiment will be described. In the printer 1 of the fourth embodiment, the drive roller 21 is configured as a grip roller which has the friction force against the sheet S. The sheet S is sent in the pullback direction D2 and passes through the grip roller by a predetermined distance when the sheet S is fed to the curl corrector 40 (FIG. 19).

With this, the sheet S is fed so as to be wound around the grip roller due to the driving force and the friction force of the grip roller against the sheet S. As a result, it is possible to correct the backward warp or reverse warp of the sheet S by passing the sheet S through the grip roller when the sheet S is overcorrected and warped backward at the curl corrector 40. That is, it is possible to straighten or flat the sheets S without such a backward warp.

It should be noted that other configurations, functions and effect of the fourth embodiment are substantially identical to those of the above-described embodiments, and therefore the description thereof is omitted.

The printer 1 of the present disclosure has been described based on the first to fourth embodiments. However, detailed configurations of the printer should not be limited to those embodiments. It should be appreciated that combinations of the embodiments, modifications of the designs, and/or additions to the design may be made by persons skilled in the art without departing from the scope of the present invention as defined by the following claims.

In the first to fourth embodiments, the sheet is a photographic paper. However, the sheet is not limited to a photographic paper and may by a plain paper.

In the first, third, and fourth embodiments, the printer 1 includes the single curl corrector 40. In the second embodiment, the printer 1 includes the two curl correctors 40. However, the number of the curl correctors may be more than two.

In the first to fourth embodiments, the user can select the feeding speed of the sheet S, the position of the guide member 42 with respect to the curl correction roller 41, and the number of the curl correction process to be applied based on the curl amount of the sheet S and the color of the image formed on the sheet S. However, the feeding speed of the sheet S, the position of the guide member 42 with respect to the curl correction roller 41, and the number of the curl correction process to be applied may be controlled automatically based on the curl amount of the sheet S and the color of the image formed on the sheet S.

In the first to fourth embodiments, the curvature radius of the curl correction route is exemplarily set to 12.5 [mm]. However, the curvature radius of the curl correction route varies depending on the thickness and/or the type of the sheet to be fed thereto.

In the first to fourth embodiments, the angle α between the first inclined surface 42*a* and the second inclined surface 42*b* is exemplarily set to 80 degrees. However, the angle α between the first inclined surface 42*a* and the second inclined surface 42*b* may be less than 80 degrees. In the first and second embodiments, the advancing direction of the sheet is exemplarily changed by 100 degrees at the curl correction route. However, the advancing direction of the sheet may be changed by more than 100 degrees at the curl correction route.

In the first to fourth embodiments, the curl correction roller 41 is exemplarily movable with respect to the guide member 42. However, the guide member 42 may be configured to be movable with respect to the curl correction roller 41.

In the first to fourth embodiments, the printer 1 is connected to the host computer 90. However, the printer may not be connected to the host computer.

In the first to fourth embodiments, the thermal printer head 5 is arranged along the first route X1 and is positioned downstream of the drive roller 21 in the feeding direction D1. However, the thermal printer head 5 may be arranged along the first route X1 and be positioned upstream of the drive roller 21 in the feeding direction D1.

In the third embodiment, the decurl amount estimation information 61*a* is exemplarily determined based on the usage of the roll paper R, the overcoat setting, the type of the roll paper (media) R, the age of the roll paper R, and the presence or absence of the high density printing. However, it should not be limited thereto.

In the fourth embodiment, the sheet S that has passed through the curl corrector 40 is exemplarily sent in the feeding direction D1 and passes through the drive roller 21 after being sent in the pullback direction D2 and passing through the drive roller 21. However, the sheet that has passed through the curl corrector 40 may be sent to the drive roller 21 multiple times.

In the first to fourth embodiments, the present disclosure is exemplarily applied to the dye-sublimation thermal transfer printer. However, the present disclosure is applicable to other printers such as a dot matrix printer, a thermal printer, a laser printer, and an inkjet printer.

What is claimed is:

1. A printer comprising:

a first route to which a sheet from a roll paper is to be fed;

a drive roller that is arranged on the first route and capable of sending the sheet in a feeding direction of the sheet and a pullback direction opposite to the feeding direction;

an image forming part that is arranged on the first route and configured to form an image on the sheet;

a second route that is branched from the first route;

a route changer that is configured to switch a route of the sheet between the first route and the second route;

a curl corrector that is provided on the second route and configured to correct curl in the sheet;

a cutter that is provided on the first route and configured to cut the sheet; and a controller, wherein the curl corrector is configured to form a route with a curl correction roller and a guide member positioned to face the curl correction roller, and wherein the controller is configured to adjust a curvature of the route at the curl corrector, a change angle of 100 degrees or more in an advancing direction of the sheet at the curl corrector, and a time for which the sheet passes through the curl corrector.

2. The printer according to claim 1, wherein the drive roller is capable of changing a feeding speed of the sheet when sending the sheet to the second route.

3. The printer according to claim 1, wherein at least one of the curl correction roller or the guide member is movable relative to the other.

4. The printer according to claim 1, wherein the route changer is capable of switching a timing for sending the sheet to the second route between before the image is formed on the sheet with the image forming part and after the image is formed on the sheet with the image forming part.

5. The printer according to claim 1, further comprising a curl correction amount adjuster that is configured to adjust a feeding amount to feed the sheet to the curl corrector for adjusting a curl correction amount.

6. The printer according to claim 1, wherein:

the drive roller is a grip roller configured to have a friction force against the sheet; and the drive roller is configured to send the sheet in the pullback direction to pass the sheet through the grip roller to a point where the curl in the sheet has been corrected by the curl corrector when the sheet is sent to the curl corrector.

7. A printer comprising:

a first route to which a sheet from a roll paper is to be fed;

a drive roller that is arranged on the first route and capable of sending the sheet in a feeding direction of the sheet and a pullback direction opposite to the feeding direction;

an image forming part that is arranged on the first route and configured to form an image on the sheet;

a second route that is downstream of the first route in the feeding direction and is connected to an ejection port provided on a top surface of the printer; and a curl corrector that is provided on the second route and configured to correct curl in the sheet, wherein the curl corrector is configured to form a route with a curl correction roller and a guide member positioned to face the curl correction roller, and wherein a curvature of the route at the curl corrector, a change angle of 100 degrees or more in an advancing direction of the sheet at the curl corrector, and a time for which the sheet passes through the curl corrector are adjustable such that the curl in the sheet is corrected without damaging the sheet.

* * * * *